US005831382A

United States Patent [19]

Bilan et al.

[11] Patent Number: 5,831,382

[45] Date of Patent: Nov. 3, 1998

[54] DISPLAY DEVICE BASED ON INDIRECTLY HEATED THERMIONIC CATHODES

[76] Inventors: Frank Albert Bilan, 2725 Castleton Dr., San Jose, Calif. 95148; Jules Joseph Jelinek, 1329 Alabama St., San Francisco, Calif. 94110

[21] Appl. No.: 722,337

[22] Filed: Sep. 27, 1996

[51] Int. Cl.[6] ..... H01J 19/04

[52] U.S. Cl. ..... 313/495; 313/422; 313/496; 313/497; 313/346 R; 445/24; 445/51

[58] Field of Search ..... 313/495, 496, 313/497, 422, 310, 346 R; 445/24, 51

[56] References Cited

U.S. PATENT DOCUMENTS

| | | | |
|---|---|---|---|
| 3,710,165 | 1/1973 | Beggs | 313/346 R |
| 3,800,186 | 3/1974 | Yamane | 315/169 TV |
| 3,855,499 | 12/1974 | Yamada | 315/169 R |
| 3,935,500 | 1/1976 | Oess | 313/495 |
| 3,979,635 | 9/1976 | Scott | 315/12 R |
| 4,020,381 | 4/1977 | Oess | 313/302 |
| 4,069,436 | 1/1978 | Nakayama et al. | 313/422 |
| 4,118,650 | 10/1978 | Scott | 313/422 |
| 4,227,117 | 10/1980 | Watanabe | 315/13 R |
| 4,333,035 | 6/1982 | Parker | 313/411 |
| 4,341,980 | 7/1982 | Noguchi | 315/169.1 |
| 4,356,427 | 10/1982 | Noguchi | 313/422 |
| 4,404,493 | 9/1983 | Nonomura | 313/422 |
| 4,417,184 | 11/1983 | Takesako | 315/366 |
| 4,540,983 | 9/1985 | Morimoto | 340/772 |
| 4,575,765 | 3/1986 | Hirt | 358/230 |
| 4,577,133 | 3/1986 | Wilson | 313/103 CM |
| 4,857,799 | 8/1989 | Spindt | 313/495 |
| 4,908,539 | 3/1990 | Meyer | 315/169.3 |
| 5,126,628 | 6/1992 | Kishimoto | 313/482 |
| 5,160,871 | 11/1992 | Tomii | 315/366 |
| 5,229,691 | 7/1993 | Shichao | 315/366 |
| 5,270,617 | 12/1993 | Nonomura | 315/167 |
| 5,378,962 | 1/1995 | Gray | 313/495 |
| 5,424,605 | 6/1995 | Lovoi | 313/422 |
| 5,475,281 | 12/1995 | Heijboer | 313/346 R |

FOREIGN PATENT DOCUMENTS

| | | |
|---|---|---|
| 62-52846 | 3/1987 | Japan . |
| 62-150638 | 7/1987 | Japan . |

*Primary Examiner*—Nimeshkumar Patel

[57] ABSTRACT

A novel self-supporting flat display screen based on thermionic emission of indirectly heated cathode structures (23, 30, 31, 32, 34; 230, 32, 34) is provided utilizing micro-filament heaters (21) that can be interconnected in any predetermined manner. The planar micro-filament (21) construction utilizes Dewer and Dewer-like techniques (10, 11, 12, 13, 14, 15) for controlling the thermal energy emitted and lowering the power consumption of a display device. Several control electrode techniques (42, 52, 33, 133, 142) are also incorporated in the invention to reduce the voltage levels required to control the display and simplify the overall electronic control circuitry needed by the display device. These techniques are combined to provide a high intensity, high contrast flat panel display using low voltage off-the-shelf electronic driver circuitry.

45 Claims, 11 Drawing Sheets

DISPLAY DEVICE BASED ON INDIRECTLY HEATED THERMIONIC CATHODES

BACKGROUND—FIELD OF INVENTION

This invention relates to flat cathodoluminescent display devices and in particular, to improved cathode structures with better thermal energy management for electron beam generation particularly useful for television receivers and computer based video display devices.

BACKGROUND—PRIOR ART

Researchers in many flat panel display technologies, such as liquid crystal displays (LCD), electro-luminescent displays (EL,TFEL), light emitting diode displays(LED), plasma discharge panels (PDP), vacuum fluorescent displays (VFD), etc., have been trying to develop technologies to build larger, less bulky, thin, inexpensive, reliable, energy efficient color displays providing fast response, high resolution, bright, and of high contrast. Although many attempts have been reported, various devices that have been proposed and built have failed to achieve one or more of the desired display attributes.

For example: conventional LCD display technology (LCD) with low power and low cost have been developed for monochrome displays but do not have sufficient speed, contrast, uniformity, power efficiency and resolution to be used in television displays and computer applications, which require full color and high speed video rates. Since LCD devices are incapable of generating light, they are used as shutters to turn on various colored filters in conjunction with various back lighting techniques. The low proportion of light transmitted from a back illumination light source transmitted by an LCD film transistor inherently limits the brightness, contrast and range of good viewing angles of an LCD based display device. LCD screens exceeding fifteen inches are continuing to be proposed but at costs that currently are not feasible for mass market commercialization, and with all of the known manufacturing and technological problems.

Because of these difficulties, research into developing large color televisions using LCD technology, has primarily focused on using projection televisions with LCD technology. Thin film electroluminescent(TFEL) displays have been developed that can potentially display large size images at video rates but are relatively energy inefficient because of the low electron to light conversion efficiency. These displays are however more expensive to produce because it is hard to create a defect free thin film over a larger area. TFEL displays are also more expensive to use since they require high voltage high current driver circuitry which is significantly more expensive than those used in some of the other types of flat panel display technologies.

Research in light emitting diode (LED) displays still has not been able to develop efficient luminescent elements for blue light of comparable quality to the luminescent elements created for other colors.

Plasma discharge panels (PDP) and vacuum fluorescent displays (VFD) have been produced with sufficient video rates and color, but also suffer from poor power efficiency and unevenness in display brightness, and are expensive due to manufacturing difficulties and the need for expensive drive electronic circuitry. Furthermore, aside from luminescent elements using zinc oxide and zinc for generating blue-green light, the brightness, efficiency and product life of other color phosphors are still not satisfactory for these technologies.

From the above, it will be evident that large screen flat full-color hang-on-the-wall televisions that have been proposed using any of the existing flat panel display technologies have not matched the image quality produced by a conventional cathode ray tube (CRT) based display and have exhibited many undesirable qualities and characteristics. This has motivated research into the technological feasibility of making cathodoluminescent CRT-like flat panel displays.

Cathode ray tubes (CRT) have been used for display purposes for many decades in applications such as in conventional television systems. Conventional CRT systems are bulky primarily because depth is necessary for an electron gun and an electron deflection system. In many applications, it is preferable to use flat display systems in which the bulk of a conventional cathodoluminescent display has been reduced. For example, in U.S. Pat. No. 3,935,500 to Oess et. al., a flat CRT system is proposed where a deflection control structure is employed between a number of cathodes and anodes. The structure has a number of holes through which electron beams may pass with sets of X-Y deflection electrodes associated with each hole. The deflection control structure defined by Oess et. al. is commonly known as a mesh-type structure. While the mesh-type structure is easy to manufacture, such structures are expensive to make particularly in the case of large structures. Oess et. al. also proposes a series connected filament cathode which results in a voltage gradient between the filament cathodes and the control electrodes with respect to screen position of said structures. This causes shadowing patterns to be visible on the screen of the display device.

In U.S. Pat. No. 3,979,635, Scott, proposes a suspended filament structure in front of an interdigitated area cathode designed to deflect and lens the electron beams towards the lens plate and subsequently to the other control electrodes, and towards the anode to the display phosphorescent material. Manufacturing of this suspended filament structure presents numerous technical difficulties. A further disadvantage of this display apparatus is that it requires high voltage circuitry to achieve generation of a visible image and will also result in image shadowing problems causes by a varying voltage gradient between the cathode/filaments and the control electrodes.

In a different patent, U.S. Pat. No. 4,118,650, Scott, proposes an internally supported flat tube display with ribs running the height of the display at periodic intervals to provide space for heated cathode filaments. As with the Oess et. al. display device, a gradient will result between the cathode and the control electrodes once again resulting in the formation of a shadowing pattern on the display screen. The Scott display apparatus also proposes the use of multiple control grids in both the row and column direction operating at different voltage potentials to cut off unwanted electron flow towards designated picture elements on the screen. This is a result of the large spacing utilized between the cathode and the various control electrodes and requires a large control voltage to overcome this inherent physical limitation of the Scott display apparatus.

U.S. Pat. No. 5,126,628, Kishimoto et. al., proposes a flat panel CRT of the conventional type utilizing a base filament emitter as the cathode having the inherent difficulties associated with induced voltage gradients between filament cathodes and the control electrodes.

U.S. Pat. No. 5,378,962, Grey et. al., proposes the use of tubular anode structures that protrude into the electron emission area to eliminate cross talk between picture element areas on the display face plate, which is not easily manufacturable. Grey et. al. also proposes the use of rows of cold cathodes of the field emission type as addressable electron sources which require special high voltage drivers to handle the large electron extraction voltages required on the column based extraction control electrodes. Field emission devices currently require ultra clean manufacturing facilities similar to those used in the microelectronics industry. As a result, large displays are expensive to manufacture and currently not technologically feasible.

Another conventional flat panel system currently used is known as the Jumbotron such as that described in Japanese Patent Publication Nos. 62-150638 and 62-52846. The structure of the Jumbotron is somewhat similar to the flat matrix CRT described above. Each anode in the Jumbotron includes less than twenty picture elements (pixels) so that it is difficult to construct a high phosphor dot density type display system using the Jumbotron structure.

Both the flat matrix CRT and the Jumbotron structures are somewhat similar in principle to the flat CRT system described by Oess et. al. discussed above. These structures amount to no more than enclosing a number of individually controlled electron guns within a panel, each gun equipped with its own grid and deflection plate electrodes for controlling the X-Y addressing and/or brightness of the display. As a result, these types of display devices are more bulky, require high voltage electronic driver circuitry, need deflection coils or plates, and are more expensive to manufacture as display device size increases.

The above-described CRT devices have another drawback. In the case of the Jumbotron and Oess et. al. system, electrical noise and other environmental factors may cause the electron beams to deviate from their intended path. Furthermore, certain electrons will inevitably stray from an electron beam and land in areas of the anode which is different from the pixel that is addressed resulting in crosstalk and degradation of the displayed image.

Another type of cathodoluminescent display is described in U.S. Pat. No. 5,424,605, Lovoi, which, although novel in material structure, however, embodies the same electron control problems of the previously mentioned patents. Like Oess et. al. and others, the cathode structure is abnormally large with all of the related thermal energy management problems.

U.S. Pat. No. 4,577,133, Wilson proposes a continuos secondary emission technique based on making semiconductive baked holes in a glass substrate for electron multiplication and acceleration. Although his method can be optionally utilized in a multitude of different display types, including any embodiment of this invention, Wilson's display does not address the myriad of technical problems associated with cathode technology and means for controlling electron emission for said based cathode technology.

While the thermionic cathode adopted as an electron beam source in a display screen provides excellent brightness, high contrast, and high speed response, when constructing a flat display device various problems are encountered involving the construction of the thermionic cathode structure and the vacuum envelope. More particularly, the various problems to be discussed hereinunder are encountered in connection to the reliability, power consumption and method of driving of the display device in which the fluorescence of a plurality of picture elements(pixels) is caused by one or more thermionic cathodes as in the prior art.

The aforementioned various problems will now be summarized.

(a) In a display device using thermionic cathodes, control of electron emission and prevention of filament cathode burn-out are issues of concern. At one end of the range is the desire to conserve power while successfully sustaining thermionic emission of electrons. At the other end of the range, filament cathode burn-out is usually caused by insufficient dissipation and/or reflection of the energy generated by the thermionic cathode structure. In displays where the fluorescence of a plurality of picture elements is made possible by a single thermionic filament cathode, the burn-out of even one filament cathode results in the defective display of the display device.

(b) In a display device using thermionic cathodes, the power consumed by the heaters constituting the thermionic cathodes account for a major portion of the total power consumed. As the number of thermionic cathodes utilized in the construction of a display device decreases, it is necessary to heat even portions that are found between adjacent picture elements so that the power consumption is increased by that amount.

(c) In a display device where the fluorescence of a plurality of picture elements is caused by a single heater, the heater is inevitably long as mentioned earlier. With a long heater, the potential difference between the opposite ends of the heater is correspondingly high. While a voltage based upon the potential present at each picture element position along the heater has to be applied to the corresponding electrodes for selectively enabling and disabling the electron beams emitted from the thermionic electron emitting portions of the heater, where the potential is high as mentioned above, it is sometimes necessary to correct the voltage applied to these controlling electrodes, in such cases inducing various technical problems. If no correction is made in such a case, shading patterns will occur on the display screen surface. If a correction is made in a flat display device having at least one heated cathode filament or groups of serially connected heating filaments, the control electrode voltage varies with position along the filament structure. This results in the need to use more complex electronic driver circuitry.

(d) In large flat display devices using thermionic cathodes, problems are encountered in supplying heating power to the thermionic cathodes where control electrode voltage gradients and shadowing patterns are to be avoided. As the area of a flat display device increases where heaters are connected in parallel and are arranged such that each corresponds to a single or very small group of picture elements, the current consumption of the heaters becomes hundreds of amperes. To successfully introduce such a large current into the vacuum envelope, various technical problems have to be solved.

(e) In thermionic display devices, the distance between the cathode and the control electrodes determine the voltage needed to control the emission of electron beams. The larger the distance between the cathode and electrode, the higher the control voltage needed. This results in many flat panel technologies needing special high voltage drivers.

(f) In the construction of a display device where each thermionic cathode corresponds to a plurality of picture elements, a means for deflecting the electron beam is often required. In such instances, the use of low voltage display driver circuitry is not possible.

(g) Conventional CRT structures utilize large deflection coils, which add to the bulk and weight of the display device and are responsible for the emission of significant amounts of electromagnetic energy. There is growing concern in the health sciences that magnetic energy above 3 milli-gauss may pose significant health risks to the human body. The elimination of such magnetic field generating circuitry, at this time does not seem to be possible in conventional CRT systems.

(h) Many flat displays encounter problems associated with the mechanical strength of the vacuum envelope enclosure. In a flat display device, the display area has diagonal length that can be, for instance, as large as, 1.2 meters. Besides, the depth of the device is very small. The vacuum envelope is formed by vacuum sealing together the front and back panel of the display individually having a large area as mentioned above. If the front and back panel of the display are both made of glass, and also, for instance, if these glass display panels have a dimensions of 1 m by 0.75 m, the front and back glass panels must have a thickness of at least 10 mm. This adds to the bulk and weight of the display. Furthermore, when atmospheric pressure is applied to the vacuum envelope, the front and back glass display panel share the compressive and tensile stresses produced so that a balanced state results. However, these stresses vary with different portions of the envelope so that compressive stress and tensile stresses always co-exist. In some flat panel designs, the tensile stress is likely to be concentrated in the glass back panel where rupture may be likely to occur.

(i) All of the display devices developed or built today use very expensive technology and/or cannot be easily adapted to build large display devices.

These problems reflect and are a result of various trends in the display industry. Early CRT design extending to present CRT designs, have utilized cathode structures that are minuscule in size in comparison to the final display screen size. In prior art attempts at flat panel CRTs, it has become apparent that the cathode structure construction is actually much larger in proportion to, even to the extend of becoming virtually the same size as, every picture element (pixel) with the inherent effect of requiring enormous amounts of power generating excessive amounts of heat. The present invention attempts to reverse this trend by constructing micro filaments and also micro sized indirectly heated cathodes.

The invention has as its additional objectives to provide a flat display device, which has means for solving the aforementioned problems (a) through (g).

SUMMARY OF PRESENT INVENTION

The flat panel display of the present invention comprises a multiplicity of electron sources for producing electron beams. Each electron source consists of an indirectly heated cathode that forms a planar electron emitting surface. These indirectly heated cathode structures are electrically interconnected through the use of electrically conductive materials, such as Al, Cu, Au etc., which is optionally used in some of the embodiments of this invention as part of the structure for selectively enabling, disabling and controlling the electron beams emitted thereof. Corresponding to each indirectly heated cathode is a micro-filament structure in close proximity providing the heat necessary for thermionic emission to result from the indirectly heated cathode.

Between the outside back surface of the display device and the micro-filaments are positioned layers of reflective materials for reflecting thermal energy back toward the micro-filaments and the indirectly heated cathode structures. These layers of reflective material thereby reduce the thermal energy dissipated and radiated through the back panel of the display. In many embodiments of the present invention, this is further enhanced by the addition of a spacer to make one or more thermally reflective vacuum chambers. It is a goal of this invention to inhibit the radiation of thermal energy using Dewer and Dewer-like Flask techniques.

Additionally, the micro filament structures use reflective techniques on the rear side of the filaments and absorptive techniques on the front side of the filaments. This further assists in and enhances the transfer of thermal energy towards the indirectly heated cathodes resulting in further power and energy efficiency. Furthermore, all of the micro-filaments can be interconnected using various parallel and series connection topologies resulting in significant energy conservation and power management.

Perpendicular to each indirectly heated cathode area is one or more layers of conductive material forming one or more control electrodes each surrounding one or more holes. The control electrodes can be used to selectively enable, disable and control the electron beams emitted into tunnels towards a light emitting phosphorescent target. The control electrodes can also be utilized to achieve individual addressing of each of the electron beams corresponding to a predetermined pixel location of the displayed image. In color embodiments of the present invention, the control electrodes may also be used to control one or more electron beams towards an appropriate phosphorescent target. The target being made of the desired phosphorescent material to produce the desired color of light.

Some embodiments of the present invention may use separate layers of control electrodes to achieve pixel addressing, and, in the case of color embodiments, separate layers for control of electron beams based on the color of a given beam's phosphorescent target. In this type of embodiment of the present invention, simplified control of color information is achieved at the expense of requiring higher voltage chrominance circuitry.

Other embodiments of the present invention may combine the addressing function and control of color information into the same layers. This requires the use of electronic driver circuitry with built in circuitry for multiplexing the color information and combining it with the pixel address information. It, however, does eliminate the need for the power consuming high voltage driver circuitry associated with using additional layers of control electrodes to separately control color information.

In some embodiments of this invention, the control electrodes are solely used to selectively enable, disable and control the emission of electrons. In other embodiments of this invention, one or more layers of control electrodes are used in conjunction with an electrically conductive material electrically interconnecting the indirectly heated cathodes. In the latter case, the electrically conductive connections to the indirectly heated cathodes and one or more layers of control electrodes jointly provide control for selectively enabling, disabling and controlling the emission of electron beams towards their respective light emitting phosphorescent targets.

Situated next to the control electrodes is a space charge zone containing one or more tunnels for accelerating electrons towards anodes surrounding one or more phosphorescent targets. In some embodiments of this invention, the tunnels provide a traditional space charge zone. In other embodiments, it is replaced by one or more electron multiplication techniques and methodologies known in the art.

At the end of each tunnel of the space charge zone is a phosphorescent target covered with a thin layer of metalization. The target and its metalization forms an anode relative to its respective cathode. The target and its metalization is routinely utilized in conventional CRT designs by the industry. The metalization further limits the thermal energy loss and improves the energy efficiency of this invention.

This display clearly has many advantages over the prior art. Among those advantages are:

(a) absence of a varying voltage gradient between the control electrodes and the cathode structure associated with other display approaches;

(b) elimination of shadowing effects due to various voltage gradients of directly heated cathode display structures;

(c) due to the structural proximity of the electron emitting source and the control elements low voltage driving circuitry such as CMOS, Bipolar etc. can be used;

(d) the capability of providing a low power energy efficient series or series parallel connection of the heater filaments;

(e) more efficient heating of the cathode structure due to use of careful management of thermal energy;

(f) provide a high contrast high intensity image producing display;

(g) provide a planar sandwich-like display structure that is self supporting and significantly more immune to atmospheric induced compressive and tensile stresses to the material structure of the display;

(h) provide a technology and methodology for manufacturing flat display devices that are very thin compared to other flat panel cathodoluminescent display apparatus proposed by those knowledgeable in the art;

(i) elimination of deflection circuitry found in convention CRT and many proposed cathodoluminescent display structures, as well as the associated magnetic fields;

(j) removal of screen size limitations present in flat display apparatus that have been proposed and/or built; and (k) provide display devices that are easier and cheaper to manufacture than current flat panel display devices or large conventional CRTs.

DRAWING FIGURES

The object and features of the present invention, as well as, various other features and advantages of the present invention will become apparent when examining the description of various selected embodiments taken in conjunction with the accompanying drawings in which:

FIG. 1 is a generalized isometric view of the display apparatus;

FIG. 2. is a sectional view showing showing a twenty-four pixel area of the internal structure of the display apparatus according to a first sample embodiment of the invention;

FIG. 3. is a detailed sectional view of one indirectly heated cathode and its associated micro filament structure as utilized in the first, second and third embodiments of the invention;

FIG. 4. is a sectional view showing showing a twenty-four pixel area of the internal structure of the display apparatus according to a second sample embodiment of the invention;

FIG. 5. is a sectional view showing showing a twenty-four pixel area of the internal structure of the display apparatus according to a third sample embodiment of the invention;

FIG. 6. is a sectional view showing showing a twenty-four pixel area of the internal structure of the display apparatus according to a fourth sample embodiment of the invention;

FIG. 7. is a detailed sectional view of an alternate indirectly heated cathode and its associated micro filament structure as utilized in the fourth and fifth sample embodiments of the invention;

FIG. 8 is a sectional view showing showing a twenty-four pixel area of the internal structure of the display apparatus incorporating an electron multiplier according to a fifth sample embodiment of this invention;

FIG. 9. is an expanded perspective view of the first panel of the electron multiplier structure incorporated in the fifth sample embodiment of this invention; and FIG. 10A to 10E illustrates some of the many tunnel to picture element allocation schemes that may be used in any embodiment of this invention.

DETAILED DESCRIPTION OF SAMPLE EMBODIMENTS

Many embodiments of the present invention are technologically possible and taught by the text of this patent. In this section of this patent, several sample embodiments will be explained with reference to their accompanying drawings.

Figure 2:
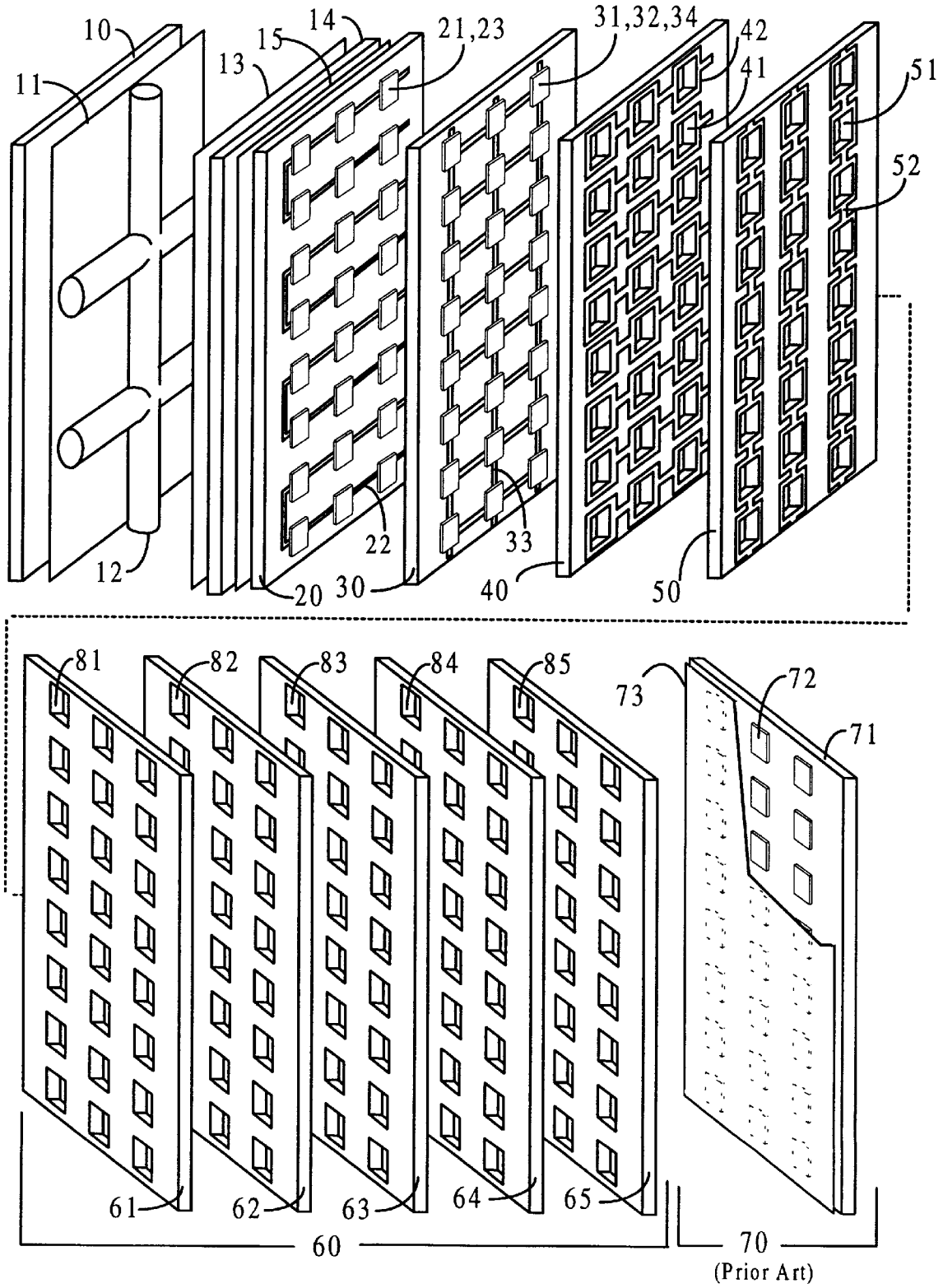
Figure 3:
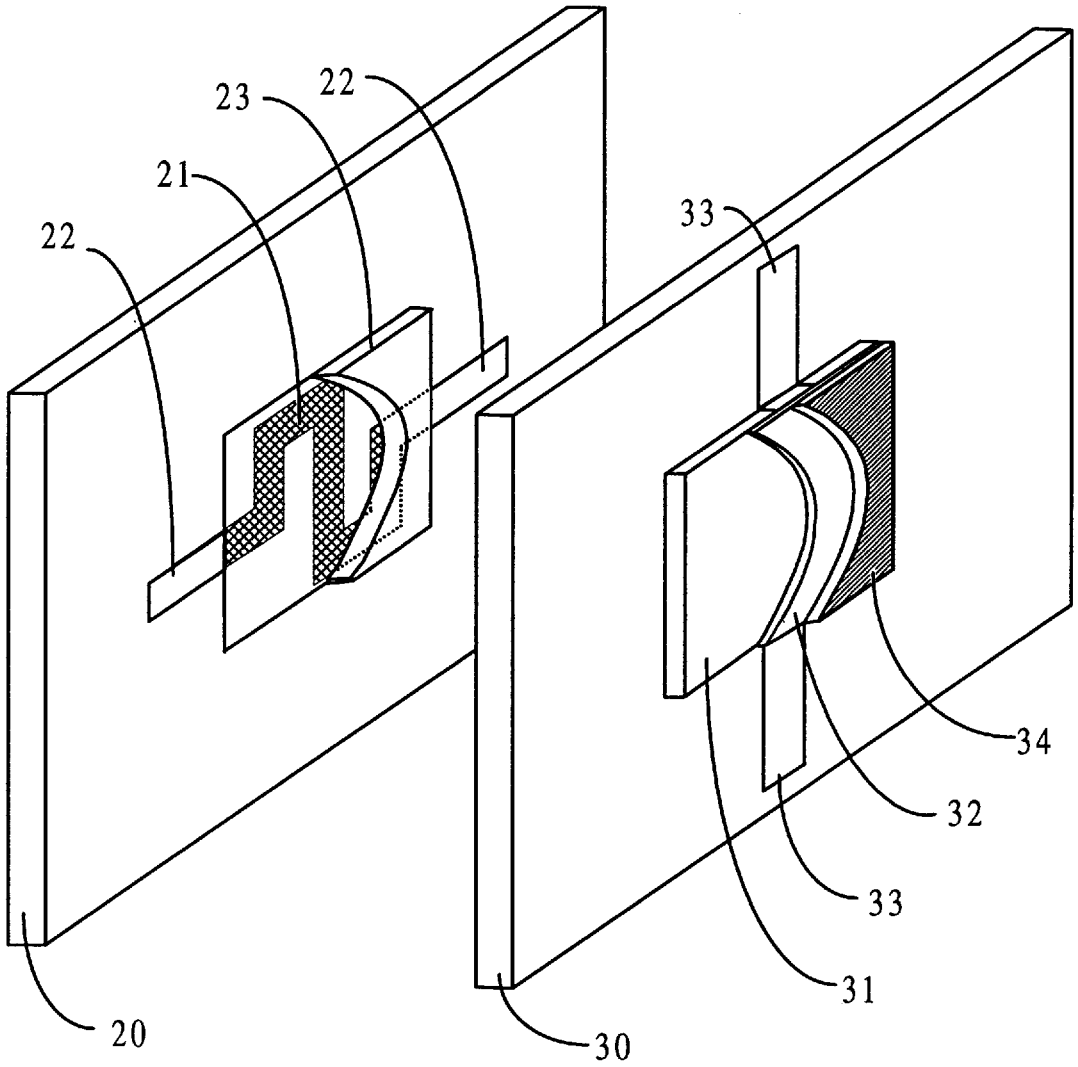

A drawing corresponding to a first sample embodiment of the invention is provided in FIG. 2 and FIG. 3. This first sample embodiment contains a back plate, 10, consisting of an insulating material with a low coefficient of expansion, such as glass. Back plate, 10, is covered on the inside surface with a thermally reflective material, 11, such as a thin film of Au, a infra-red reflective coating, etc. Immediately in contact with the thermally reflective material, 11, is a spacer, 12, made of glass, ceramic, metal or other material appropriate for use as a spacer. Although many different shapes, sizes and types of spacer may be used, the spacer, 12, illustrated in this particular embodiment is a mesh shaped spacer. Resting in contact on the opposite side of the spacer, 12, is an insulating material, 14, such as glass. Insulating material, 14, is coated on both sides with a thermally reflective material, 13 and 15 respectively, such as, a thin film containing Au, Al, an infrared reflective coating, etc., to thermally reflect any extraneous heat generated by the microfilaments, 21. The combination of back plate 10, thermally reflective material 11, spacer, 12, thermally reflective material, 13, and insulating material, 14, create a vacuum chamber for increased thermal insulative purposes. Although only one vacuum chamber is utilized in this first sample embodiment of the invention, it is clear to those skilled in the art, that this invention could be built with a multitude of similar chambers constructed immediately adjacent to each other in parallel planes.

Immediately in contact with thermally reflective material, 15, is a high temperature insulating material, 20, with a low coefficient of expansion, such as commercially available Pyrex (TM) glass. On high temperature insulating material, 20, is deposited a layer of thin metal material traces, 21, such as W, Ni, an alloy containing Ni and W, an alloy containing W and Re, or other appropriate heater material for forming micro-filaments. In areas where thin metal material, 21, is not acting as a micro-filament, a layer of highly electrically conductive metal, 22, such as Au, Al, Cu, etc., is deposited. Highly electrically conductive metal, 22, electrically short thin metal material, 21, in areas where filament heating is not desired. Immediately above each active micro-filament area is deposited corresponding islands of a thermally conductive material, 23, such as a black oxide material or coating similar or identical to those used by the incandescent lamp industry. The purpose of thermally conductive material, 23, is to absorb and transmit the heat generated by the microfilaments towards indirectly heated cathodes, 31, 32, and 34. Heat from the back side of the micro-filament, 21, is reflected by reflective coating, 15, on insulating material, 14, back into thermally conductive material areas, 23, which provides better energy efficiency.

Resting against the thermally conductive material is another very thin layer of high temperature insulating material with a low coefficient of expansion, 30, similar to high temperature insulating material, 20. Deposited on this high temperature insulating material, 30, are islands of thermally conductive material, 31, similar and corresponding to black oxide islands, 23. These islands of thermally conductive material, 31, act as receptors for the heat transmitted by conduction or radiation through high temperature insulating material, 30, from thermally conductive material, 23. Overlaying each of the thermally conductive material islands, 31, are deposited similar shaped areas of an electrically conductive material, 32, such as a thin film of Au, Cu, Al, etc. During the deposition of these islands of electrically conductive material, 32, interconnecting traces, 33, are simultaneously created. These interconnecting traces, 33, electrically connect islands, 32, in a predetermined manner. The electrically conductive material, 32, is then coated with an electron emissive material, 34, such as, BaO, etc., forming planar indirectly heated cathodes. Electron emissive materials, such as that utilized for electron emissive material, 34, are well known in the field of thermionic emission.

Although many different structures and materials may be used in an embodiment of this invention, items 23, 30, 31, 32, and 34, are used to form an emissive conductive cathode region, hereinafter, also referred to as an indirectly heated cathode structure.

Opposite, the indirectly heated cathode structures, is a thin layer of insulating material, 40, such as a layer or sheet of glass, containing multiple etched holes, 41, of a predetermined shape. Although many shapes of holes are possible, such as circular, square, rectangular, triangular etc., in this sample embodiment, rectangular holes were selected for purposes of demonstrating the invention in this embodiment. All of the etched holes are situated in line with and perpendicularly to the areas of electron emissive material, 34. The periphery area of the etched holes on the far side of insulating material, 40, is coated with rows of thin electrically conductive material, 42, such as Al, Cu, Au, etc. These rows of electrically conductive material, 42, form a row of control electrodes for selectively inhibiting, enabling and controlling the emission of electrons from the indirectly heated cathode structures.

Opposite electrically conductive material, 42, is a second thin layer of insulating material, 50, such as a layer of glass, containing multiple etched holes, 51, of a predetermined shape coincident with the holes, 41, in insulating material, 40. The side of glass, 50, not facing glass, 40, is also coated with rows of thin electrically conductive material, 52, such as Al, W, Cu, Au, etc. These rows of electrically conductive material, 52, form rows of control electrodes oriented perpendicular to and situated in a plane parallel to electrically conductive material, 42, forming another set of control electrodes. Electrically conductive layer, 42, in conjunction with electrically conductive material, 52, provide a method for addressing the phosphorescent display elements in a two dimension X-Y addressing scheme. It is further intended that the electrode control layers 42 and 52 surrounding every hole perform the Boolean AND logic function.

Situated opposite control electrode layer, 52, are multiple layers of insulating materials, 60, such as multiple layers of glass and/or similar materials, 61, 62, 63, 64 and 65, containing a multiplicity of etched holes, 81, 82, 83, 84, and 85. Holes, 81, 82, 83, 84, and 85 collectively create a plurality of tunnels forming a space charge area for accelerating electrons towards their individual phosphorescent targets, 72 on display screen, 70. The tunnels, 67, in the multiple layers of insulating material, 60, have openings of similar shape and size coincident with the holes in insulating material, 40 and 50, and in line with the indirectly heated cathode structure. Although the space charge region in this embodiment was implemented using five layers of insulating material 61, 62, 63, 64 and 65, it would also be possible to use a greater or a lesser number of layers of insulating material to create an appropriately sized space charge region.

Upon exiting the tunnels in the space charge area, 60, the electrons immediately encounter a layer of metalization, 73, deposited on the back side of the front face plate of the display. The front face plate comprising 71, 72, and 73, is collectively referred to as the display screen, 70. The screen, 70, is fabricated according to techniques well known by the cathode ray tube display industry.

The metalization, 73, performs many functions in this invention. It provides an electrically conductive layer for use as the anode electrode in the display device, increases the photon emissive efficiency of the phosphorescent display screen material, and lowers the total power consumption of the entire display device by further reflecting thermal energy back towards the indirectly heated cathode structures. The electrically conductive layer, 73, may also be manufactured from a highly thermally reflective material, such as, Al or similar material, thus forming a partial heat shield and forward photon reflecting layer.

Figure 1:
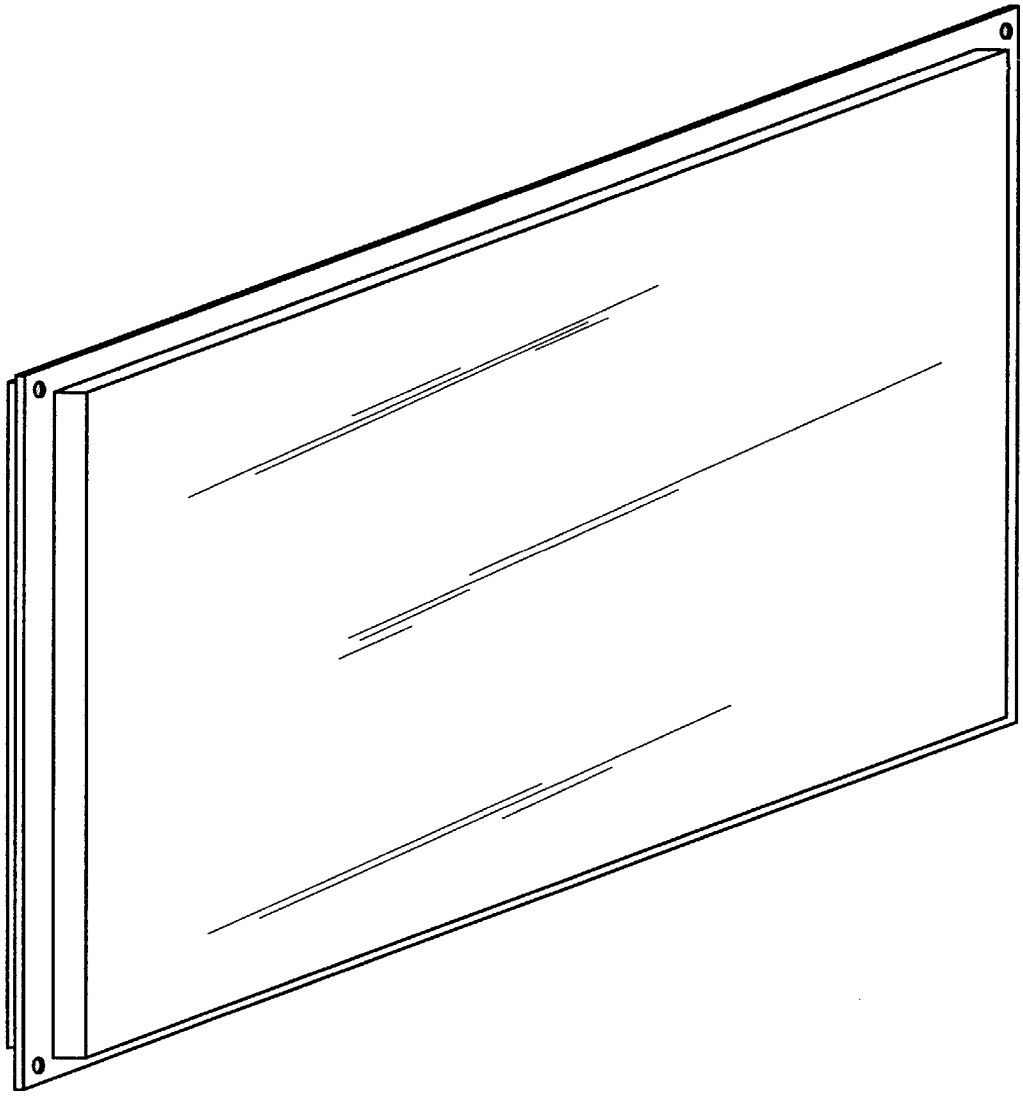

The final step in manufacturing any embodiment of the present invention is to place the structure in a in a hermetically sealed vacuum housing, such as the one shown with the display device in FIG. 1 to facilitate the emission of electrons for cathodoluminescence to begin. Although the structure can be placed in the housing mentioned above with atmospheric pressure of at least 10E-06 torr to facilitate the emission of electrons, a better method is available in this embodiment of the present invention. Due to the deliberate use of many glass and glass-like layers of material, it is preferable in this embodiment of the invention to fuse together the layers of glass at a high temperature thus creating the vacuum structures necessary for the emission of electrons. In some embodiments of the present invention, this may be done in connection with the application of suitable frit-seal material between various or all of the substrates before they are fused together at high temperature.

Figure 4:
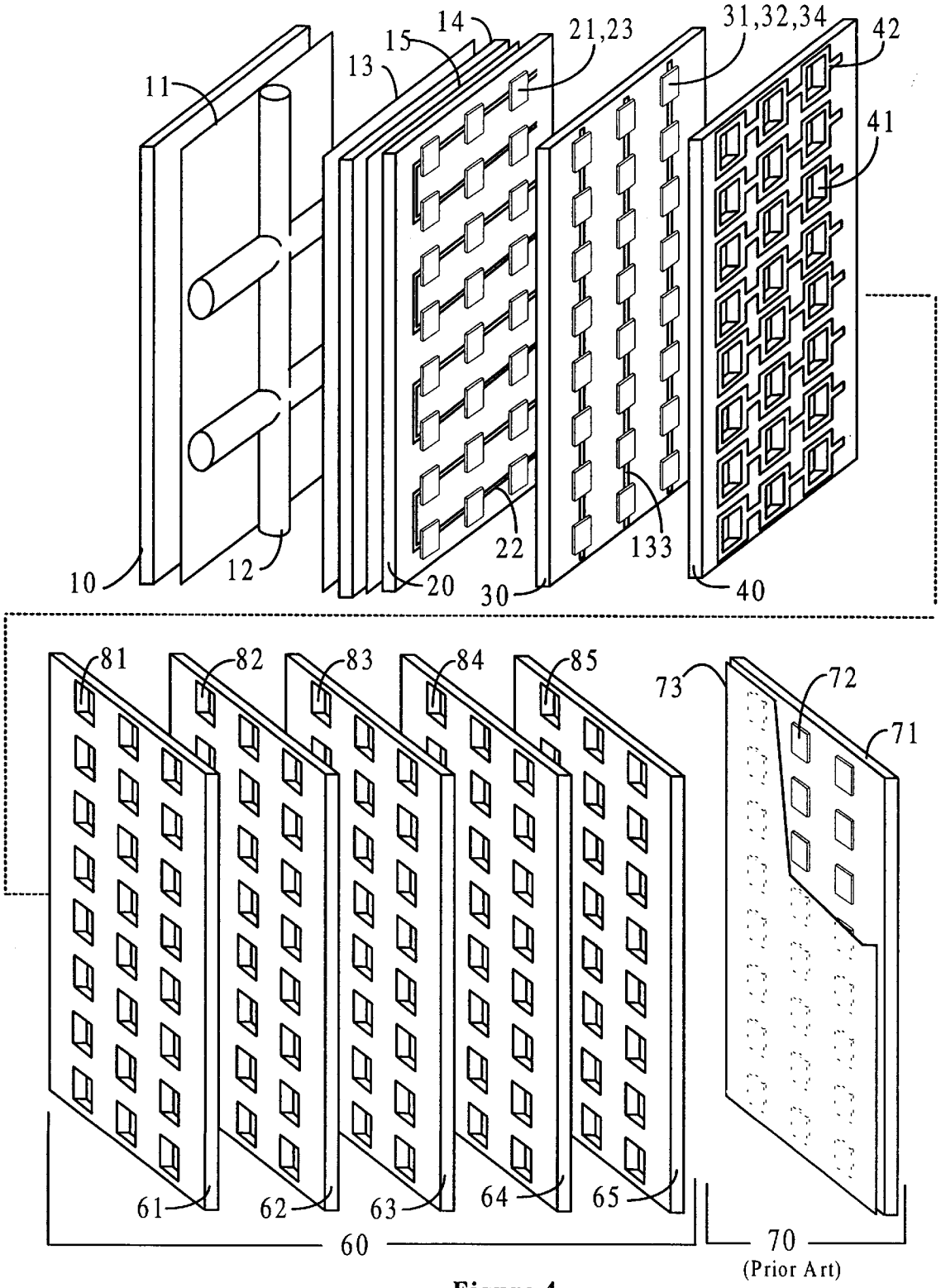

A second sample embodiment of the present invention is illustrated in FIG. 4 showing one of a plurality of alternate control electrode methodologies that is possible and hereby incorporated into the scope of this invention by reference. In this second embodiment of the present invention, traces, 33, are no longer connected in an arbitrarily determined manner. Traces, 33, are now utilized to form rows of interconnected islands, 32, oriented perpendicular to and situated in a plane parallel to electrically conductive material, 42, to form another set of control electrodes. These row connected traces are identified as traces, 133, in FIG. 4. Electrically conductive layer, 32, in conjunction with electrically conductive material, 42, provide a method for addressing the phosphorescent display elements in a two dimension X-Y addressing scheme. Layer, 33, interconnects rows of indirectly heated cathode structures allowing rows of indirectly heated cathode structures to be selectively controlled. Electrically conductive material, 42, is then used to selectively control electron emission in a perpendicularly aligned row (column) of the display device. It is further intended that traces, 33, interconnecting islands, 32, in conjunction with 42 provide the Boolean AND logic function. This further simplifies and lowers the cost of manufacturing for an embodiment of the present invention.

Although the first sample embodiment demonstrates a method of electron beam control where the X and Y direction electrodes can operate at low voltages, the second embodiment provides a further advantage. The second embodiment provides a Boolean logic AND function whose electron emission and inhibiting voltages, although not equal, are much closer in terms of magnitude of low voltage required. This, in turn, allows the electronic control circuitry employed for driving this display apparatus to be of a lower voltage nature.

Figure 5:
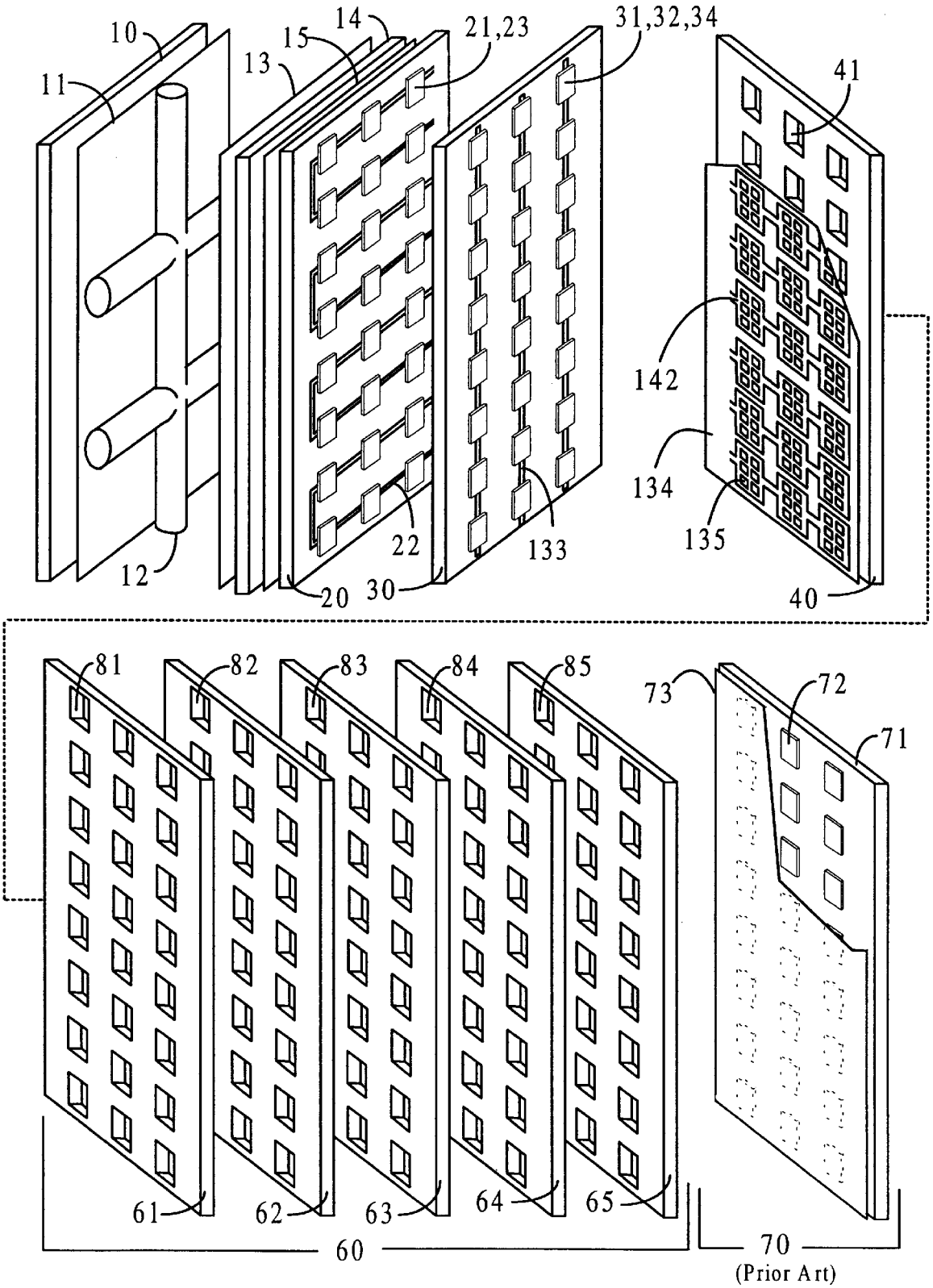

A third sample, and more preferred embodiment of this invention is illustrated in FIG. 5. This embodiment provides an example of another plurality of alternate control electrode methodologies that are possible and herein incorporated into the scope of this invention.

In the third embodiment of the present invention, control electrodes, 42, are fabricated on the backside of high temperature insulating material, 40, instead of the front side as in the above previous embodiments of the present invention. These electrodes are identified as electrodes, 142, in FIG. 5. In this embodiment, electrodes, 142, comprises a very thin sheet of metal such as, W, Al, etc. which is first bonded to insulative material, 40. Then an array of very small holes coincident with large holes, 41, and the rows(columns) of control electrode metalizations are etched. A layer of thin insulator, 134, such as silicon dioxide, containing etched holes, 135, is then grown on top of control electrodes, 142, using techniques well known to the micro-electronics industry. Thus, the thickness of insulator, 134, sets the magnitude and range of control voltage required to selectively enable, disable and control the amount of thermionic electron emission created by the indirectly heated cathode structures. If the thickness of insulator, 134, is made only hundreds of angstroms thick, the control voltage required can be provided by relatively low voltage electronic driver circuitry. This capability makes the third sample embodiment of this invention more preferable.

With careful design of the insulating material's thickness, 134, utilized to space control electrode, 142, from the indirect cathode structure, 23, 30, 31, 32, and 34, it is also possible and preferable to use similar drive electronic circuitry. The drive electronic circuitry can preferably be set to operate in similar voltage ranges but at different levels of potential. For example, metalization rows, 133, operating between V2-delta V1 and V2, and control electrode metalization, 142, between V2 and V2+delta V1.

Figure 6:
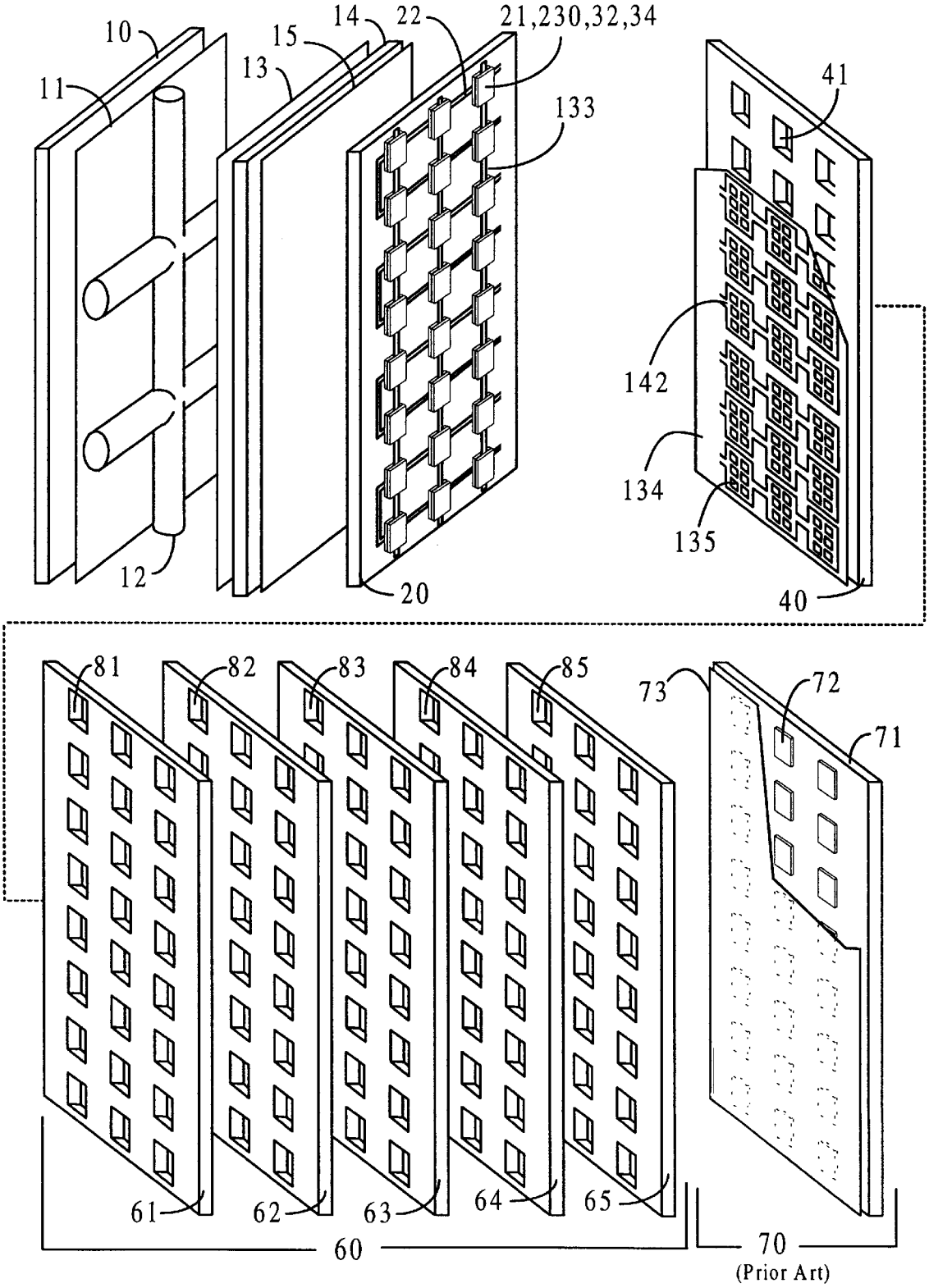
Figure 7:
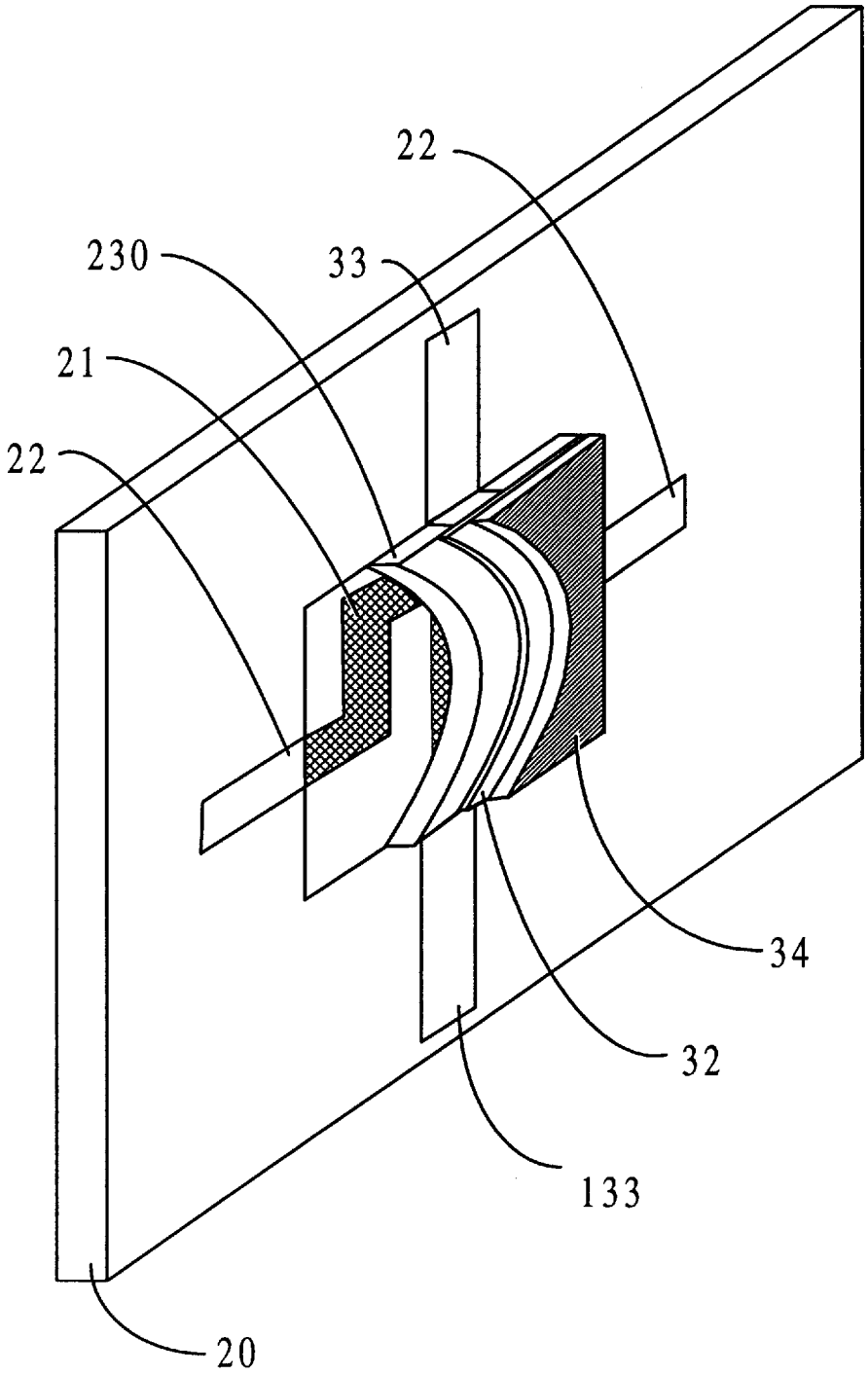

A fourth and even more preferable sample embodiment of this invention is illustrated in FIG. 6, and FIG. 7, showing yet another cathode structure constructed according to the present invention. In this fourth embodiment of the present invention, thermally conductive material, 23, high temperature insulating material, 30, thermally conductive material, 31, are replaced by a single layer of planarized islands of planarized thermally conductive material, 230. This thermally conductive material, 230, should have infinite or very high high electrical resistivity, such as a baked on layer of thick film resistive paste, thin film resistive paste, or other similar material known to the thick film, thin film or electrical component manufacturing industries. This baked on layer is then etched using traditional lithographic techniques to form islands of thermally conductive material. It is clear that by further reducing the distance between microfilaments, 21, and islands of electrically conductive material, 32, a higher and more sophisticated level of thermal energy management and efficiency is achieved. This results in a further reduction in the energy consumption of a display device constructed according to this invention. The additional energy savings is primarily due to the closer proximity achieved between the indirectly heated cathode structures and the control electrodes over that of the first, second, and third sample embodiments of the present invention.

Figure 8:
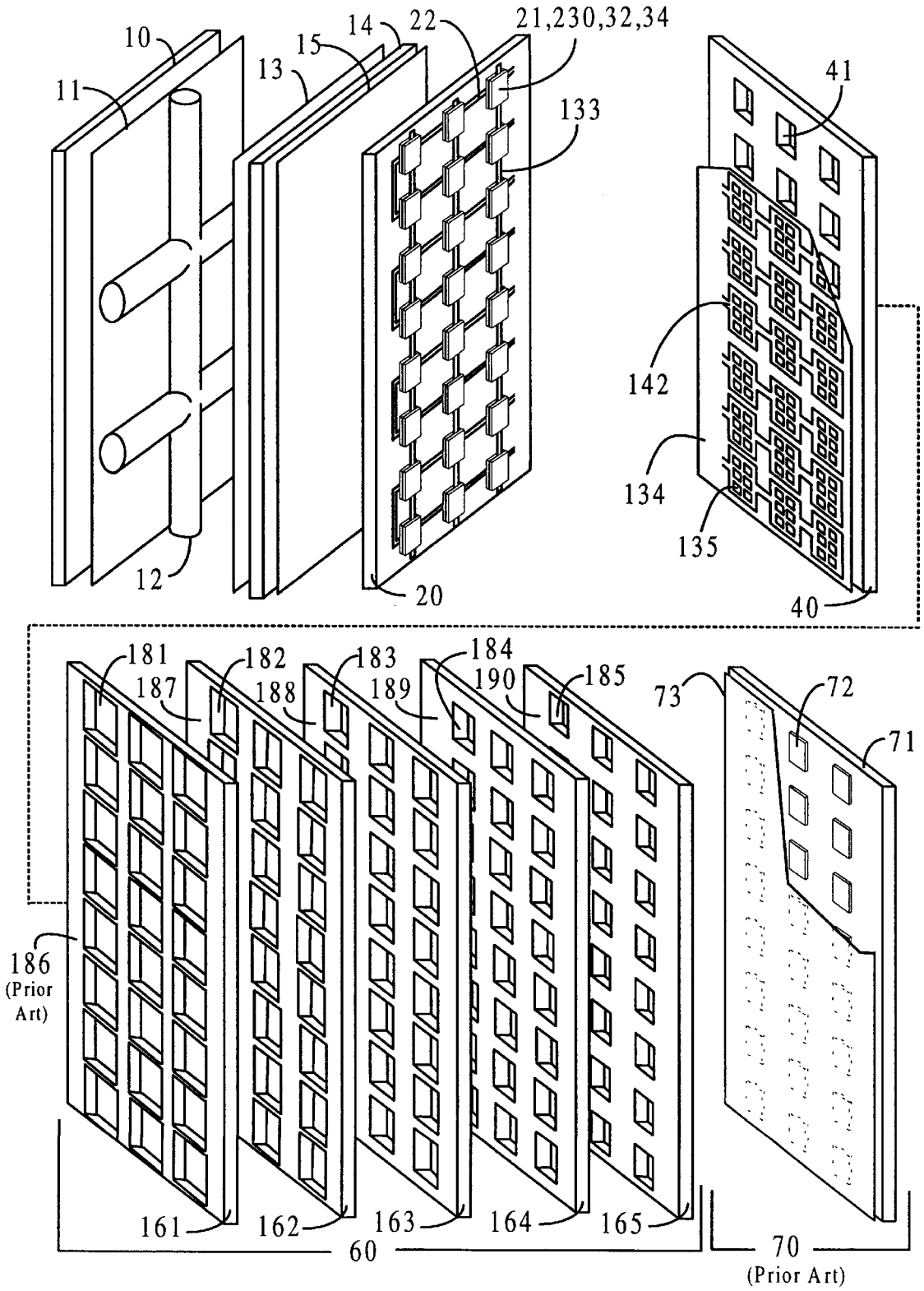
Figure 9:
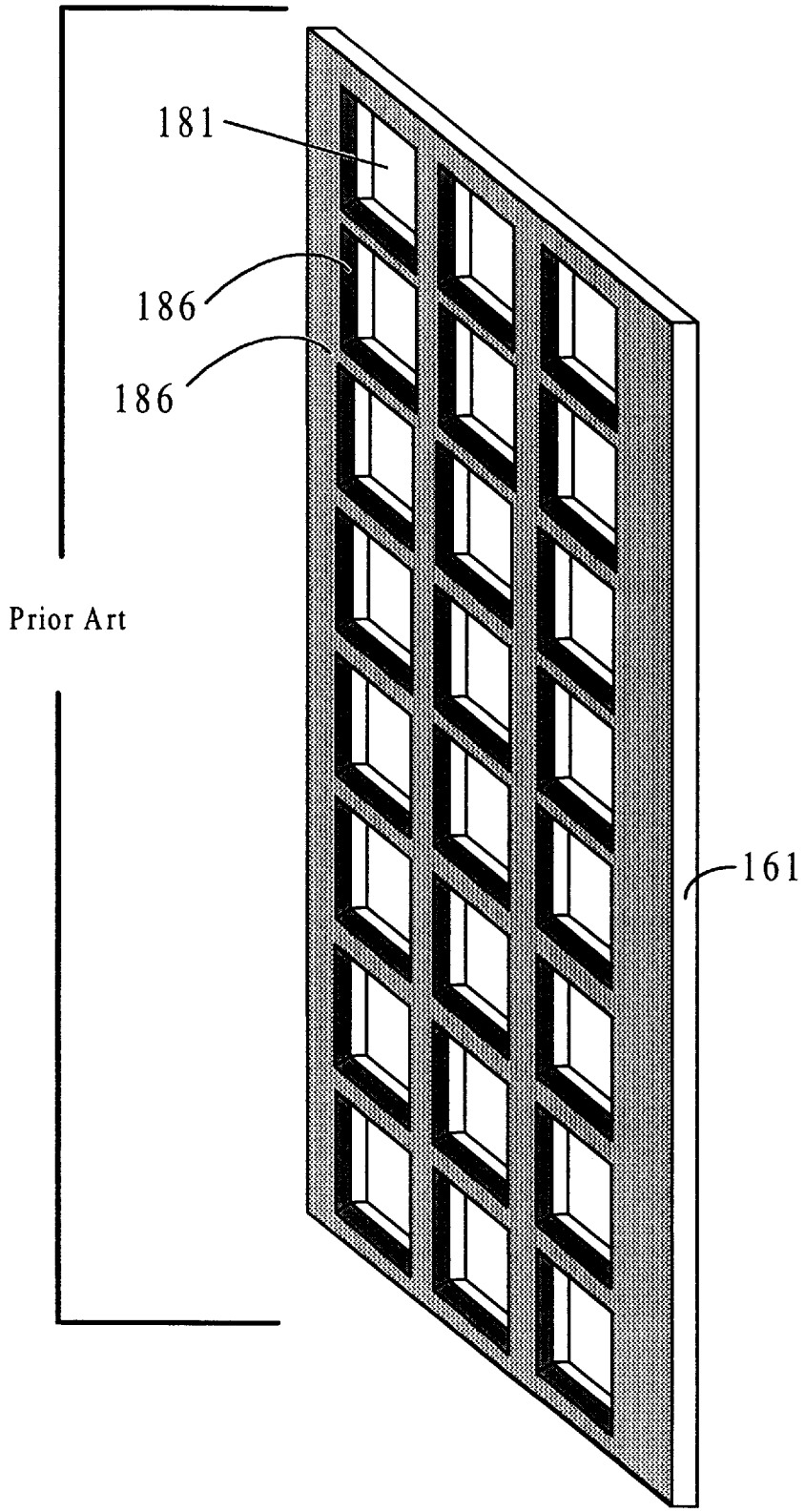

Another plurality of embodiments of this invention can be built incorporating an electron multiplier in the tunnels of the space charge area, 60. The fifth sample embodiment of the present invention, as illustrated in FIG. 8 and 9, provides an explanatory embodiment of how an electron multiplier can be incorporated into this invention. Although the fifth embodiment is based on adding an electron multiplier to the fourth embodiment of this invention, it is possible to incorporate an electron multiplier structure into any embodiment of this invention, which are hereby incorporated by reference.

In this embodiment, a plurality of layers of insulative material, 161, 162, 163, 164, and 165, such as layers of glass, with diminishing sized holes, 181, 182, 183, 184, and 185. In this embodiment, five layers of insulative material were arbitrarily selected and sandwiched together. Each layer of this insulative material, 161, 162, 163, 164, and 165 is then coated with an electron emissive and conductive material, 186, 187, 188, 189, and 190, respectively, such as a layer of CsO, polysilicon, or other ion-implanted material. The purpose of the layers of electron emissive and conductive material 186, 187, 188, 189 and 190 is to provide a means for increasing the density of the electron beam. This is achieved by providing successively increasing voltage potentials to layers 186, 187, 188, 189, and 190.

The first layer of insulative material, 161, has holes of a similar size corresponding to the hole position, 41, in insulative material, 40. The next layer of insulative material, 162, contains holes, 182, of uniformly diminishing size corresponding to the hole position in insulative layer, 161. A similar relationship exists for layers 163, 164, and 165 and holes 183, 184 and 185 respectively. A predetermined number of layers are then fabricated in a similar manner creating an electron emitting multiplier structure. Although only five sets of identical materials were used in this exemplary embodiment, namely, 181, 182, 183, 184, 185, 186, 187, 188, 189, and 190; any appropriate number of such similar layers can be used. The number of layers used is determined by the electron bombardment energy required by phosphorescent targets, 72.

To those in the art, it is understood that an electron multiplier for any embodiment of this invention could be constructed using any predetermined number of glass layers with increasing levels of electrical potential being applied. It is further possible that this, as well as, other electron multiplier schemes known to the art, may also be incorporated into any embodiment of this invention, and are hereby incorporated by reference.

In any embodiment of the present invention, each indirectly heated cathode structure can provide a source of emitted electrons to transmit through one or more tunnels to one or more types of light emitting phosphorescent material of one or more colors for one or more addressable picture element locations on the display apparatus screen. The driving of multiple locations by one indirectly heated cathode has the additional advantage of saving addition energy. This, in turn, further reduces problems associated with the management of excess emitted thermal energy.

Figure 10A:
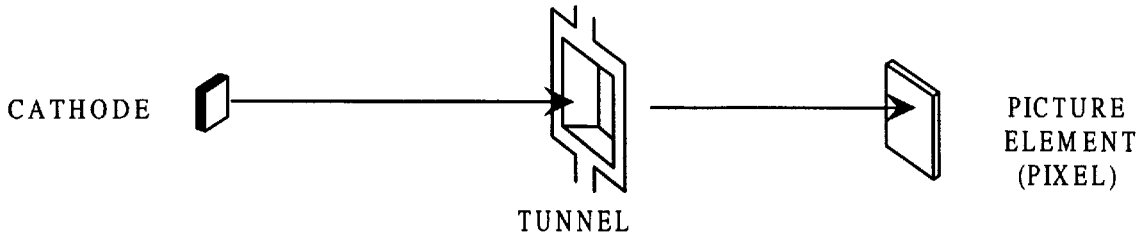
Figure 10B:
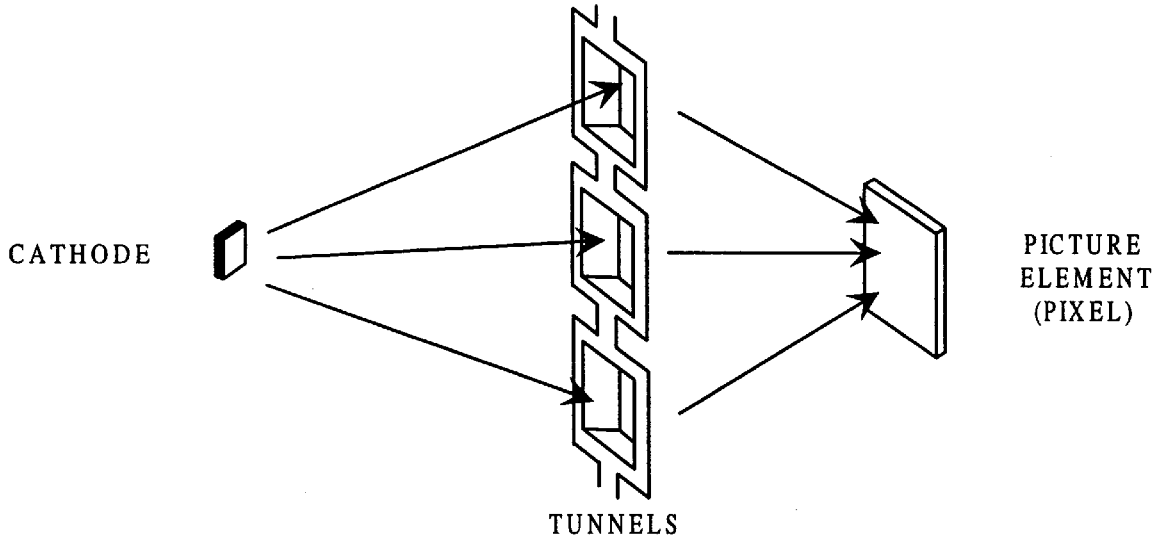
Figure 10C:
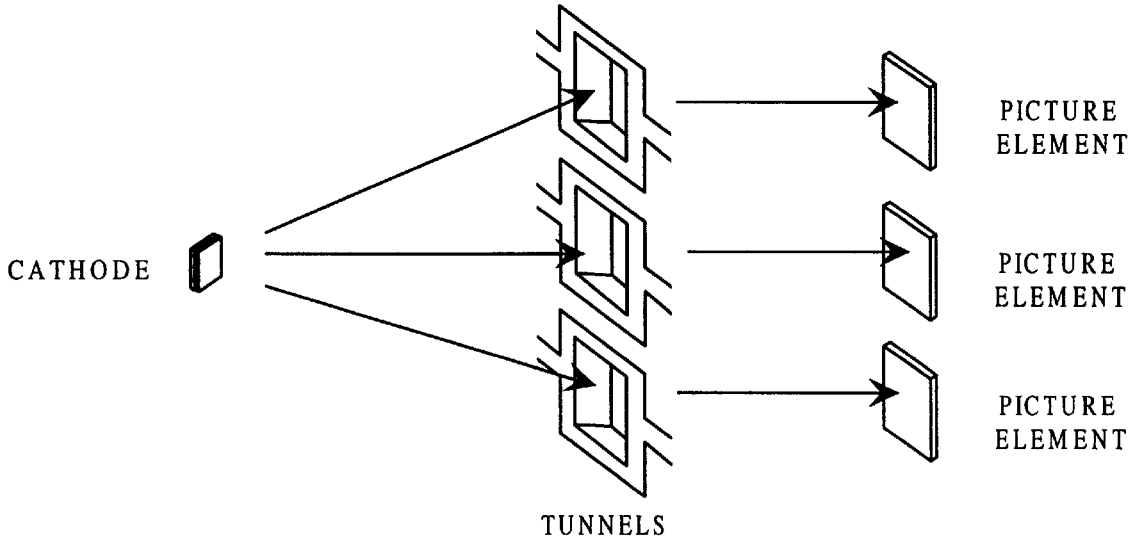
Figure 10D:
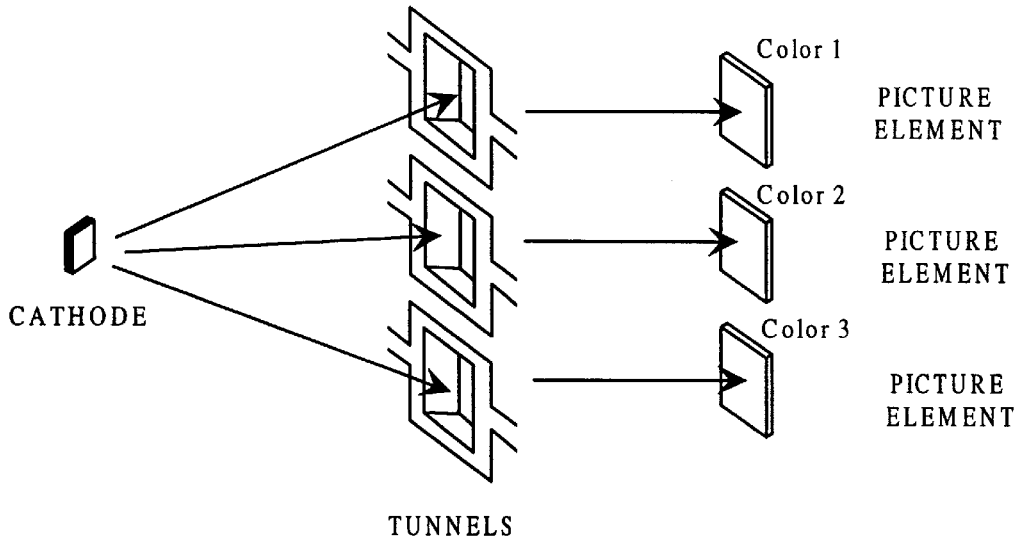
Figure 10E:
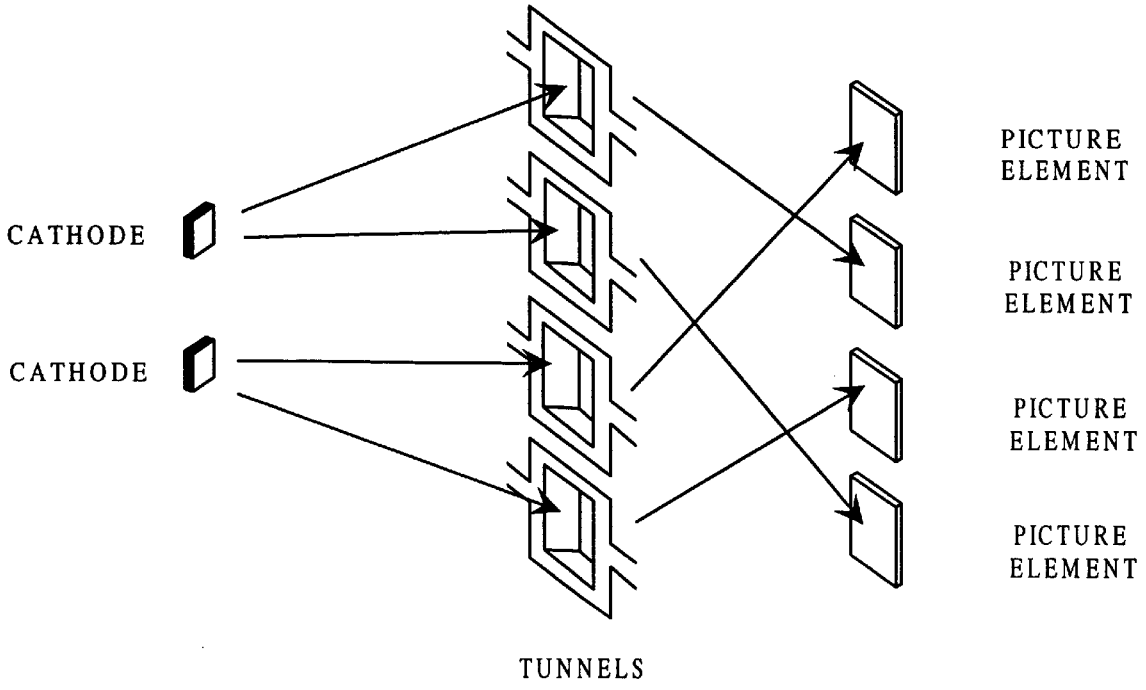

FIG. 10A through FIG. 10E show several allocation schemes for all of the tunnel outputs corresponding to a single indirectly heated cathode structures with respect to addressable picture elements and phosphorescent materials used. In FIG. 10A, shows a single tunnel originating from a given indirectly heated cathode. FIG. 10B, shows a plurality of tunnels originating from a single indirectly heated cathode structure targeted towards a commonly addressed phosphorescent picture element location emitting a single color light. FIG. 10C illustrates a plurality of tunnels originating from a single indirectly heated cathode targeted towards three light emitting phosphorescent materials at a single picture element location on the screen. FIG. 10D shows a plurality of tunnels originating from a single indirectly heated cathode targeted towards three different colors of light emitting phosphorescent material at multiple picture element locations. FIG. 10E, illustrates tunnels from two indirectly heated cathode structures being targeted at multiple picture element locations. From the examples presented in FIG. 10A through 10E, it is clear that an infinite number of tunnel allocation schemes are possible which are intended to be covered by the scope of this invention and are hereby included by reference.

Each of the elements shown in the various embodiments can be connected in a multitude of combinations creating a plurality of embodiments with single or multiple tunnels provided for every indirectly heated cathode structure. Every indirectly heated cathode structure is used to stimulate single or multiple light emitting phosphorescent materials capable of emitting different wavelengths of visible light. Although these embodiments are not specifically enumerated in this patent, they are hereby incorporated by reference.

It is also an object of this invention to achieve better control of electron beam shut-off through favorable selection of tunnel hole height to hole aperture sizing.

This may result in the desire to have each indirectly heated cathode emit electrons through multiple tunnels directed towards each phosphorescent picture element, 72, on the display screen, rather than emitting electrons through a single tunnel for a given color of light emitting phosphor, 72. It is actually a further advantage in some embodiments of this invention to provide several holes and tunnels with electrons originating from a single indirectly heated cathode for every different color of light emitting phosphor targets, 72, provided. This results in further thermal energy management.

Differently shaped chambers, holes and tunnels are appropriate to different types of screens and also to the number of colors selected in a color complement for a pixel. If four-color pixels are selected, square-shaped or diamond-shaped geometries may be more preferable. In this regard, although red, green, and blue colors are referred to in the above description, illustrations and figures, this is not intended to limit the invention in this aspect, and four-color, five-color, etc. may alternately be used.

Similarly, in the manufacturing of the chambers, holes and tunnels, lithographic techniques, well known to the micro-electronics, semiconductor and materials industries, are used in conjunction with dry etching, wet etching, wet and dry etching, plasma etching, and mechanical boring techniques well known to the micro-electronics, semiconductor, materials and mechanical industries.

Although all of the sample embodiments of the invention presented utilize a multitude of thermally reflective layers to provide a high level of thermal energy efficiency, it is further possible to build a display according to this invention utilizing none, a selective combination of a few, or all of the following layers, of which are hereby incorporated by reference: thermally reflective coating, 11; spacers 12; thermally reflective layer, 13; insulating material, 14; thermally reflective layer, 15; a reflective anode, 73. In a simpler manner, other embodiments of this invention can be built where one or more additional layers of thermally reflective material have been added. This, in turn will further improve the thermal efficiency of an embodiment of the present invention, all of which are also hereby incorporated by reference.

Although back plate, 10, and spacer, 12, were utilized in all of the above illustrated sample embodiments, to those in the art it is clear that back plate, 10, and spacer, 12, could be built as a single layer of thermally reflective material containing a myriad of etched cavities. Similarly, any of the thermally reflective layers utilized in any embodiment of this invention could alternately be constructed of textured, etched, machined, contoured, etc. layers of thermally reflective materials, which are hereby included by reference into the scope of this invention.

Although many different structure and material may be used to form indirectly heated cathode structures, items 23, 30, 31, 32, and 34 provide one example; and items 23, 230, 32, and 34 provide a second example of a multitude of embodiments for building indirectly heated cathode structures according to the present invention that henceforth is clear to those skilled in the art of thermionic emission. It is a further intent of this invention to allow similar and different indirectly heated cathode structures to be used in embodiments of the present invention which are hereby incorporated by reference.

To those in the art, it is understood that the indirectly heated cathode structure of this invention can be utilized with single or multiple layers of control electrodes manufactured from various electrically conductive materials. These layers of control electrodes separately or in conjunction with indirectly heated cathode metalization, 32, in any combination thereof for controlling the emission of electrons into tunnels of the space charge area in any combination and are hereby incorporated by reference.

The front screen, 70, can also be manufactured in multiple layers consisting of a front glass plate with a thermally reflective coating on the inside, and another glass plate consisting of the phosphor targets with a black matrix optionally placed between the targets to assist in contrast enhancement, which are presently used in the television manufacturing industry. Additional, the viewing side may be coated with anti-glare and/or transparent conductive coatings to prevent static charge build-up. These are all techniques and technologies known to and practiced in the manufacture of conventional television receiver and computer display technologies.

Although many terms are used in the above description of the present invention and various sample embodiments, they should be interpreted broadly. Furthermore, any new and revolutionary display technology, such as that of the present invention, requires broad interpretation of traditional terms used and inherently covers a wide range of new and old manufacturing techniques and options, which are hereby incorporated by reference. The following terms and partial definitions are provided to aid in clarity and understanding of the presents invention's scope and technology:

a) The term "chamber" is intended to encompass not only cubed shaped chambers, but also, rectangular shaped chambers, circular shaped chambers, trapezoidal shaped chambers, triangular shaped chambers or any other shape of chamber which is appropriate for a particular embodiment of this invention.

b) The term "hole" is intended to encompass not only circular holes, but also slot-shaped holes, elliptical holes, hexagonal holes, triangular holes, or any other shape which might be appropriate for a particular application or selected arrangement of control electrodes and pixels. Differently shaped holes are appropriate to different types of screens and also to the number of colors selected in a color complement for a pixel.

c) The term "tunnel" is also intended to encompass not only circular shaped tunnels, but also slot-shaped tunnels, elliptical shaped tunnels, hexagonal shaped tunnels, triangular tunnels, or any other shape tunnels which are appropriate for a particular application or selected arrangement of the pixels.

d) The terms "glass", "glass-ceramic" or "ceramic" are often used herein to refer to the family of glass, ceramic, glass-ceramic, or ceramic glass materials as described earlier. In this invention, it is preferable from a reliability stand-point that the "glass", "glass-ceramic" and "ceramic" utilized in the construction of the display device all have very similar coefficients of expansion.

e) The term "electrically conductive", is often used herein to refer to the family of metal, and semiconductive materials that permit the flow of electrical energy.

f) The term "thermally reflective" is often used herein to refer to the family of metal, non-metal, thin film, ceramic and glass products that reflect thermal energy, such as Au, and various proprietary thin film infra-red (IR) reflective coatings used by and developed for various industries.

g) The term "lithography" is often used in connection with conductive materials but is intended in the broadest sense. Lithography should be understood to include but not be limited to lithography; flat plate printing technologies; screen printing techniques; various lithography techniques utilized by the display, microelectronics and semiconductor industries; as well as other known printing and image creation techniques.

h) The term "picture element" and "pixel" have been used interchangeably. With respect to the present invention, a pixel is defined to refer to a single picture element location on a display screen. This picture element location may utilize only one color of light emitting phosphorescent material; utilize each of a red, green and blue light emitting phosphorescent color; or utilize any number of light emitting phosphorescent materials of varying colors, as indicated previously throughout this document.

SUMMARY, RAMIFICATIONS, AND SCOPE

This invention provides a high contrast high intensity flat screen display that could be used for cathode ray tube replacements, television screens (regular, high definition, portable, large, medium, small, bulky, thick, thin, flat, etc.), radar screens, computer display screens (regular, high definition, portable, large, medium, small, bulky, thick, thin, flat, etc.), gun sights, night vision goggles, vehicular display panels (cars, boats, planes, trains, military vehicles, etc.), instrumentation indicators (character and screen based), printing devices, electronic printing devices, etc.

Most importantly, the invented technology disclosed in this patent eliminates the physical limitations present in prior art with regard to actual active display screen surface area. Accordingly, it will be clear to the reader that indirectly heated cathode methods and technologies when utilized in a flat screen display solves the image shadowing problem, provides a mechanism for utilizing serially connect micro filaments, solves and controls the emission of thermal energy or heat, greatly reduces the power consumption of a display, and ultimately can be used to provide a display capable of using low voltage driver circuitry, and provides a self supporting structure with significantly more surface to surface contacting support. The novel indirectly heated cathode structure proposed combined with various combinations of the control electrode embodiments discussed previously, eliminate voltage gradients between the electron emitting sources and the control electrodes. The indirectly heated cathode structure also provide some alternative ways for selectively enabling and disabling electron emission through the tunnels to the light emitting phosphorescent materials deposited near the front screen of the display apparatus.

Although the description above contains many specificities, these should not be construed as limiting the scope of the inventions but are merely providing illustrations of some of the presently preferred embodiments of the invention. For example, the thermally reflective cavities could be shaped differently; the electrode controls for selectively controlling the emission of electrons could be a combination of techniques illustrated in the different embodiments; the use of each indirectly heated cathode structure as an electron emissive source for several pixels instead of a single pixel phosphorescent material on the display screen apparatus, etc.

Thus, the scope of the invention should be determined by the following claims and their legal equivalents, rather than by the examples provided.

What is claimed is:

1. A cathode array for an image display device including a phosphorescent screen having a plurality of pixels characterized in that said cathode array comprises:

a first layer of insulating material;

an array of filaments coupled to said first layer of insulating material and comprising at least one thousand filaments wherein each filament of said array of filaments corresponds to a pixel of said plurality of pixels on said phosphorescent screen;

a plurality of islands of thermally conductive material wherein each island of said plurality of islands of thermally conductive material is in contact with a corresponding filament of said array of filaments; and a plurality of electrically conductive islands coated on at least one surface with a low work force electron emissive material wherein each island of said plurality of islands of thermally conductive material is in contact with a corresponding island of said plurality of electrically conductive islands.

2. A cathode array for an image display device including a phosphorescent screen having a plurality of pixels as claimed in claim 1, said cathode array further comprising:

a layer of reflective material wherein said first layer of insulating material is positioned between said layer of reflective material and said array of filaments.

3. A cathode array for an image display device including a phosphorescent screen having a plurality of pixels as claimed in claim 1, said cathode array further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively, is positioned between two layers of said plurality of layers of reflective material.

4. A cathode array for an image display device including a phosphorescent screen having a plurality of pixels as claimed in claim 3 wherein said i-th layer of said plurality of layers of insulating material, is a spacer having a plurality of holes.

5. A cathode array and control structure for an image display device including a phosphorescent screen having a plurality of pixels characterized in that said cathode array and control structure comprises:

a first layer of insulating material;

an array of filaments coupled to said first layer of insulating material and comprising at least one thousand filaments;

a plurality of islands of thermally conductive material wherein each island of said plurality of islands of thermally conductive material is in contact with a corresponding filament of said array of filaments; p1 a plurality of electrically conductive islands coated on at least one surface with a low work force electron emissive material wherein each island of said plurality of islands of thermally conductive material is in contact with a corresponding island of said plurality of electrically conductive islands, a second layer of insulating material having a plurality of holes, positioned such that said plurality of holes in said second layer of insulating material correspond to said plurality of electrically conductive islands coated with said low work force electron emissive material, and coupled to said electrically conductive islands coated with said low work force electron emissive material; and a plurality of control electrodes coupled to said second layer of insulating material wherein said plurality of electrically conductive islands in combination with said plurality of control electrodes are configured to be capable of substantially inhibiting thermionic emission from energizing said phosphorescent screen sufficiently to generate visible light with an electrical potential of less than one hundred volts coupled between said plurality of electrically conductive islands and said plurality of control electrodes.

6. A cathode array and control structure for an image display device including a phosphorescent screen having a plurality of pixels as claimed in claim 5, said cathode array and control structure further comprising:

a layer of reflective material wherein said first layer of insulating material is positioned between said layer of reflective material and said array of filaments.

7. A cathode array and control structure for an image display device including a phosphorescent screen having a plurality of pixels as claimed in claim 5, said cathode array and control structure further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively, is positioned between two layers of said plurality of layers of reflective material.

8. A cathode array and control structure for an image display device including a phosphorescent screen having a plurality of pixels as claimed in claim 7 wherein said i-th layer of said plurality of layers of insulating material, is a spacer having a plurality of holes.

9. A cathode array and control structure for an image display device including a phosphorescent screen having a plurality of pixels characterized in that said cathode array and control structure comprises:

a first layer of insulating material;

an array of filaments coupled to said first layer of insulating material;

a plurality of islands of thermally conductive material wherein each island of said plurality of islands of thermally conductive material is in contact with a corresponding filament of said array of filaments;

a plurality of electrically conductive islands coated on at least one surface with a low work force electron emissive material wherein each island of said plurality of islands of thermally conductive material is in contact with a corresponding island of said plurality of electrically conductive islands, a plurality of electrically conductive traces wherein said plurality of electrically conductive traces electrically couple groups of said electrically conductive islands in said plurality of electrically conductive islands;

a second layer of insulating material having a plurality of holes and positioned such that said plurality of holes in said second layer of insulating material correspond to said plurality of electrically conductive islands coated with said low work force electron emissive material; and a plurality of control electrodes coupled to said second layer of insulating material wherein a) said plurality of control electrodes are divided into groups of electrically coupled control electrodes, and b) said plurality of electrically conductive traces and said plurality of control electrodes define a multi-dimensional array.

10. A cathode array and control structure for an image display device including a phosphorescent screen having a plurality of pixels as claimed in claim 9, said cathode array and control structure further comprising:

a layer of reflective material wherein said first layer of insulating material is positioned between said layer of reflective material and said array of filaments.

11. A cathode array and control structure for an image display device including a phosphorescent screen having a plurality of pixels as claimed in claim 9, said cathode array and control structure further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively is positioned between two layers of said plurality of layers of reflective material.

12. A cathode array and control structure for an image display device including a phosphorescent screen having a plurality of pixels as claimed in claim 11 wherein said i-th layer of said plurality of layers of insulating material, is a spacer having a plurality of holes.

13. A cathode array for an image display device including a phosphorescent screen having a plurality of pixels characterized in that said cathode array comprises:

a first layer of insulating material;

an array of filaments coupled to said first layer of insulating material and comprising at least one thousand filaments wherein each filament of said array of filaments corresponds to a pixel of said plurality of pixels on said phosphorescent screen;

a plurality of islands of thermally conductive materials, wherein a) each island of said plurality of islands of thermally conductive materials comprises a plurality of layers of thermally conductive materials, and b) each island of said plurality of islands of thermally conductive materials is in contact with a corresponding filament of said array of filaments; and a plurality of electrically conductive islands coated on at least one surface with a low work force electron emissive material wherein each island of said plurality of islands of thermally conductive materials is in contact with a corresponding island of said plurality of electrically conductive islands.

14. A cathode array for an image display device including a phosphorescent screen having a plurality of pixels as claimed in claim 13, said cathode array further comprising:

a layer of reflective material wherein said first layer of insulating material is positioned between said layer of reflective material and said array of filaments.

15. A cathode array for an image display device including a phosphorescent screen having a plurality of pixels as claimed in claim 13, said cathode array further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively is positioned between two layers of said plurality of layers of reflective material.

16. A cathode array for an image display device including a phosphorescent screen having a plurality of pixels as claimed in claim 15, wherein said i-th layer of said plurality of layers of insulating material, is a spacer having a plurality of holes.

17. A cathode array for an image display device including a phosphorescent screen having a plurality of pixels as claimed in claim 13, said cathode array further comprising a layer of electrically insulative material positioned between two layers of said plurality of layers of thermally conductive materials in said plurality of islands of thermally conductive materials.

18. A cathode array for an image display device including a phosphorescent screen having a plurality of pixels as claimed in claim 17, said cathode array further comprising a layer of reflective material wherein said first layer of insulating material is positioned between said layer of reflective material and said array of filaments.

19. A cathode array for an image display device including a phosphorescent screen having a plurality of pixels as claimed in claim 17, said cathode array further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively.

20. A cathode array for an image display device including a phosphorescent screen having a plurality of pixels as claimed in claim 19 wherein said i-th layer of said plurality of layers of insulating material, is a spacer having a plurality of holes.

21. A cathode array and control structure for an image display device including a phosphorescent screen having a plurality of pixels characterized in that said cathode array and control structure comprises:

a first layer of insulating material;

an array of filaments coupled to said first layer of insulating material and comprising at least one thousand filaments;

a plurality of islands of thermally conductive materials wherein a) each island of said plurality of islands of thermally conductive materials comprises a plurality of layers of thermally conductive materials, and b) each island of said plurality of islands of thermally conductive materials is in contact with a corresponding filament of said array of filaments;

a plurality of electrically conductive islands coated on at least one surface with a low work force electron emissive material wherein each island of said plurality of islands of thermally conductive materials is in contact with a corresponding island of said plurality of electrically conductive islands;

a second layer of insulating material having a plurality of holes, positioned such that said plurality of holes in said second layer of insulating material correspond to said plurality of electrically conductive islands coated with said low work force electron emissive material, and coupled to said electrically conductive islands coated with said low work force electron emissive material; and a plurality of control electrodes coupled to said second layer of insulating material wherein said plurality of electrically conductive islands in combination with said plurality of control electrodes are configured to be capable of substantially inhibiting thermionic emission from energizing said phosphorescent screen sufficiently to generate visible light with an electrical potential of less than one hundred volts coupled between said plurality of electrically conductive islands and said plurality of control electrodes.

22. A cathode array and control structure for an image display device including a phosphorescent screen having a plurality of pixels as claimed in claim 21, said cathode array and control structure further comprising:

a layer of reflective material wherein said first layer of insulating material is positioned between said layer of reflective material and said array of filaments.

23. A cathode array and control structure for an image display device including a phosphorescent screen having a plurality of pixels as claimed in claim 21, said cathode array and control structure further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively, is positioned between two layers of said plurality of layers of reflective material.

24. A cathode array and control structure for an image display device including a phosphorescent screen having a plurality of pixels as claimed in claim 23 wherein said i-th layer of said plurality of layers of insulating material, is a spacer having a plurality of holes.

25. A cathode and control structure for an image display device including a phosphorescent screen having a plurality of pixels as claimed in claim 21, said cathode array and control structure further comprising a layer of electrically insulative material positioned between two layers of said plurality of layers of thermally conductive materials in said plurality of islands of thermally conductive materials.

26. A cathode array and control structure for an image display device including a phosphorescent screen having a plurality of pixels as claimed in claim 25, said cathode array and control structure further comprising a layer of reflective material wherein said first layer of insulating material is positioned between said layer of reflective material and said array of filaments.

27. A cathode array and control structure for an image display device including a phosphorescent screen having a plurality of pixels as claimed in claim 25, said cathode array and control structure further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively, is positioned between two layers of said plurality of layers of reflective material.

28. A cathode array and control structure for an image display device including a phosphorescent screen having a plurality of pixels as claimed in claim 27, wherein said i-th layer of said plurality of layers of insulating material, is a spacer having a plurality of holes.

29. A cathode array and control structure for an image display device including a phosphorescent screen having a plurality of pixels characterized in that said cathode array and control structure comprises:

a first layer of insulating material;

an array of filaments coupled to said first layer of insulating material;

a plurality of islands of thermally conductive materials wherein a) each island of said plurality of islands of thermally conductive materials comprises a plurality of layers of thermally conductive materials, and b) each island of said plurality of islands of thermally conductive materials is in contact with a corresponding filament of said array of filaments;

a plurality of electrically conductive islands coated on at least one surface with a low work force electron emissive material wherein each island of said plurality of islands of thermally conductive materials is in contact with a corresponding island of said plurality of electrically conductive islands;

a plurality of electrically conductive traces wherein said plurality of electrically conductive traces electrically couple groups of said electrically conductive islands in said plurality of electrically conductive islands;

a second layer of insulating material having a plurality of holes and positioned such that said plurality of holes in said second layer of insulating material correspond to said plurality of electrically conductive islands coated with said low work force electron emissive material; and a plurality of control electrodes coupled to said second layer of insulating material wherein a) said plurality of control electrodes are divided into groups of electrically coupled control electrodes; and b) said plurality of electrically conductive traces and said plurality of control electrodes define a multi-dimensional array.

30. A cathode array and control structure for an image display device including a phosphorescent screen having a plurality of pixels as claimed in claim 29, said cathode array and control structure further comprising:

a layer of reflective material wherein said first layer of insulating material is positioned between said layer of reflective material and said array of filaments.

31. A cathode array and control structure for an image display device including a phosphorescent screen having a plurality of pixels as claimed in claim 29, said cathode array and control structure further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively, is positioned between two layers of said plurality of layers of reflective material.

32. A cathode array and control structure for an image display device including a phosphorescent screen having a plurality of pixels as claimed in claim 31 wherein said i-th layer of said plurality of layers of insulating material, is a spacer having a plurality of holes.

33. A cathode and control structure for an image display device including a phosphorescent screen having a plurality of pixels as claimed in claim 29, said cathode array and control structure further comprising a layer of electrically insulative material positioned between two layers of said plurality of layers of thermally conductive materials in said plurality of islands of thermally conductive materials.

34. A cathode array and control structure for an image display device including a phosphorescent screen having a plurality of pixels as claimed in claim 33, said cathode array and control structure further comprising:

a layer of reflective material wherein said first layer of insulating material is positioned between said layer of reflective material and said array of filaments.

35. A cathode array and control structure for an image display device including a phosphorescent screen having a plurality of pixels as claimed in claim 33, said cathode array and control structure further comprising:

a plurality of layers of reflective material; and a plurality of layers of insulating material, identified as first through n-th respectively, wherein a) said first layer of insulating material is said first layer of said plurality of layers of insulating material, b) said first layer of said plurality of layers of insulating material is positioned between said array of filaments and a layer of said plurality of layers of reflective material, and c) another layer of said plurality of layers of insulating material, identified as an i-th layer respectively, is positioned between two layers of said plurality of layers of reflective material.

36. A cathode array and control structure for an image display device including a phosphorescent screen having a plurality of pixels as claimed in claim 35, wherein said i-th layer of said plurality of layers of insulating material, is a spacer having a plurality of holes.

37. A method of manufacturing a cathode array for an image display device including a phosphorescent screen having a plurality of pixels, said method comprising the steps of:

providing a first layer of insulating material;

providing an array of filaments coupled to said first layer of insulating material and comprising at least one thousand filaments wherein each filament of said array of filaments corresponds to a pixel of said plurality of pixels on said phosphorescent screen;

providing a plurality of islands of thermally conductive materials, wherein a) each island of said plurality of islands of thermally conductive materials comprises a plurality of layers of thermally conductive material, and b) each island of said plurality of islands of thermally conductive materials is in contact with a corresponding filament of said array of filaments; and providing a plurality of electrically conductive islands in contact with a corresponding island of said plurality of islands of thermally conductive materials, and coated on at least one surface with a low work force electron emissive material, whereby the thermal energy transferred by said layer of thermally conductive material from said array of filaments to said plurality of electrically conductive islands excites said low work force electron emissive material permitting said plurality of electron beams to be extracted.

38. A method of manufacturing a cathode array for an image display device including a phosphorescent screen having a plurality of pixels, said method comprising the steps of:

providing a first layer of insulating material;

providing an array of filaments coupled to said first layer of insulating material and comprising at least one thousand filaments wherein each filament of said array of filaments corresponds to a pixel of said plurality of pixels on said phosphorescent screen;

providing a plurality of islands of thermally conductive materials wherein each island of said plurality of islands of thermally conductive materials is in contact with a corresponding filament of said array of filaments; and providing a plurality of electrically conductive islands in contact with a corresponding island of said plurality of islands of thermally conductive material, and coated on at least one surface with a low work force electron emissive material, whereby the thermal energy transferred by said layer of thermally conductive materials from said array of filaments to said plurality of electrically conductive islands excites said low work force electron emissive material permitting said plurality of electron beams to be extracted.

39. A method of manufacturing a cathode array and control structure for an image display device including a phosphorescent screen having a plurality of pixels, said method comprising the steps of:

providing a first layer of insulating material;

providing an array of filaments coupled to said first layer of insulating material;

providing a plurality of islands of thermally conductive material wherein each island of said plurality of islands of thermally conductive material is in contact with a corresponding filament of said array of filaments;

providing a plurality of electrically conductive islands coated on at least one surface with a low work force electron emissive material wherein each island of said plurality of islands of thermally conductive material is in contact with a corresponding island of said plurality of electrically conductive islands, providing a plurality of electrically conductive traces wherein said plurality of electrically conductive traces electrically couple groups of said electrically conductive islands in said plurality of electrically conductive islands;

providing a second layer of insulating material having a plurality of holes and positioned such that said plurality of holes in said second layer of insulating material correspond to said plurality of electrically conductive islands coated with said low work force electron emissive material; and providing a plurality of control electrodes coupled to said second layer of insulating material wherein a) said plurality of control electrodes are divided into groups of electrically coupled control electrodes, and b) said plurality of electrically conductive traces and said plurality of control electrodes define a multi-dimensional array.

40. A method for increasing the energy efficiency of an image display device including an array of indirectly heated cathodes having an array of filaments comprising at least one thousand filaments, said method comprising the steps of:

providing at least one layer of reflective material; and providing at least one layer of insulating material positioned between said layer of reflective material and said array of filaments so as to provide space for reflecting a portion of the thermal energy generated by said array of filaments towards said array of filaments to reduce the amount of electrical energy required to heat said array of filaments.

41. A method for increasing the energy efficiency of an image display device including an array of indirectly heated cathodes having an array of filaments comprising at least one thousand filaments, said method comprising the steps of:

providing a plurality of layers of reflective material; and providing a plurality of layers of insulating material with at least one layer of said plurality of layers of insulating material positioned between said array of filaments and one of said plurality of layers of reflective material, and at least one other layer of said plurality of layers of insulating material, identified as an i-th layer respectively, positioned between two of said plurality of layers of reflective material, whereby said plurality of layers of reflective material reflect a portion of the thermal energy generated by said array of filaments and reduce the amount of electrical energy required to heat said array of filaments.

42. A method as defined in claim 41, wherein said i-th layer of said plurality of layers of insulating material provided, is a spacer having a plurality of holes.

43. A method of manufacturing a cathode array and control structure for an image display device including a phosphorescent screen having a plurality of pixels, said method comprising the steps of:

providing a first layer of insulating material;

providing an array of filaments coupled to said first layer of insulating material;

providing a plurality of islands of thermally conductive materials wherein a) each island of said plurality of islands of thermally conductive materials comprises a plurality of layers of thermally conductive materials, and b) each island of said plurality of islands of thermally conductive materials is in contact with a corresponding filament of said array of filaments;

providing a plurality of electrically conductive islands coated on at least one surface with a low work force electron emissive material wherein each island of said plurality of islands of thermally conductive materials is in contact with a corresponding island of said plurality of electrically conductive islands;

providing a plurality of electrically conductive traces wherein said plurality of electrically conductive traces electrically couple groups of said electrically conductive islands in said plurality of electrically conductive islands;

providing a second layer of insulating material having a plurality of holes and positioned such that said plurality of holes in said second layer of insulating material correspond to said plurality of electrically conductive islands coated with said low work force electron emissive material; and providing a plurality of control electrodes coupled to said second layer of insulating material wherein a) said plurality of control electrodes are divided into groups of electrically coupled control electrodes, and b) said plurality of electrically conductive traces and said plurality of control electrodes define a multi-dimensional array.

44. A method of manufacturing a cathode array and control structure for an image display device including a phosphorescent screen having a plurality of pixels, said method comprising the steps of:

providing a first layer of insulating material;

providing an array of filaments coupled to said first layer of insulating material and comprising at least one thousand filaments;

providing a plurality of islands of thermally conductive material wherein each island of said plurality of islands of thermally conductive material is in contact with a corresponding filament of said array of filaments;

providing a plurality of electrically conductive islands coated on at least one surface with a low work force electron emissive material wherein each island of said plurality of islands of thermally conductive material is in contact with a corresponding island of said plurality of electrically conductive islands, providing a second layer of insulating material having a plurality of holes, positioned such that said plurality of holes in said second layer of insulating material correspond to said plurality of electrically conductive islands coated with said low work force electron emissive material, and coupled to said electrically conductive islands coated with said low work force electron emissive material; and providing a plurality of control electrodes coupled to said second layer of insulating material wherein said plurality of electrically conductive islands in combination with said plurality of control electrodes are configured to be capable of substantially inhibiting thermionic emission from energizing said phosphorescent screen sufficiently to generate visible light with an electrical potential of less than one hundred volts coupled between said plurality of electrically conductive islands and said plurality of control electrodes.

45. A method of manufacturing a cathode array and control structure for an image display device including a phosphorescent screen having a plurality of pixels, said method comprising the steps of:

providing a first layer of insulating material;

providing an array of filaments coupled to said first layer of insulating material and comprising at least one thousand filaments;

providing a plurality of islands of thermally conductive materials wherein a) each island of said plurality of islands of thermally conductive materials comprises a plurality of layers of thermally conductive material, and b) each island of said plurality of islands of thermally conductive materials is in contact with a corresponding filament of said array of filaments;

providing a plurality of electrically conductive islands coated on at least one surface with a low work force electron emissive material wherein each island of said plurality of islands of thermally conductive materials is in contact with a corresponding island of said plurality of electrically conductive islands;

providing a second layer of insulating material having a plurality of holes, positioned such that said plurality of holes in said second layer of insulating material correspond to said plurality of electrically conductive islands coated with said low work force electron emissive material, and coupled to said electrically conductive islands coated with said low work force electron emissive material; and providing a plurality of control electrodes coupled to said second layer of insulating material wherein said plurality of electrically conductive islands in combination with said plurality of control electrodes are configured to be capable of substantially inhibiting thermionic emission from energizing said phosphorescent screen sufficiently to generate visible light with an electrical potential of less than one hundred volts coupled between said plurality of electrically conductive islands and said plurality of control electrodes.

* * * * *